US011623329B2

(12) United States Patent
Dittmer et al.

(10) Patent No.: US 11,623,329 B2
(45) Date of Patent: Apr. 11, 2023

(54) MULTI-TOOL

(71) Applicant: Wolf Tooth Components, LLC, Savage, MN (US)

(72) Inventors: Daniel D. Dittmer, Shakopee, MN (US); Jack W. Hinkens, Eden Prairie, MN (US); Jonathan E. Rosemeier, Prior Lake, MN (US); Michael W. Pfeiffer, Savage, MN (US)

(73) Assignee: Wolf Tooth Components, LLC, Burnsville, MN (US)

( * ) Notice: Subject to any disclaimer, the term of this patent is extended or adjusted under 35 U.S.C. 154(b) by 779 days.

(21) Appl. No.: 16/351,484

(22) Filed: Mar. 12, 2019

(65) Prior Publication Data

US 2019/0275651 A1 Sep. 12, 2019

Related U.S. Application Data

(60) Provisional application No. 62/641,585, filed on Mar. 12, 2018.

(51) Int. Cl.
*B25B 27/22* (2006.01)
*B25B 27/00* (2006.01)
(Continued)

(52) U.S. Cl.
CPC ..... *B25B 27/22* (2013.01); *B25B 7/02* (2013.01); *B25B 7/08* (2013.01); *B25B 7/22* (2013.01); *B25B 27/0071* (2013.01); *B25G 1/08* (2013.01)

(58) Field of Classification Search
None
See application file for complete search history.

(56) References Cited

U.S. PATENT DOCUMENTS 1,510,953 A * 10/1924 Murphy ..... B60C 27/08 81/15.8
D150,222 S * 7/1948 Giles ..... D8/58
(Continued)

FOREIGN PATENT DOCUMENTS

TW M485775 9/2014
TW 201531384 8/2015
(Continued)

OTHER PUBLICATIONS

BiB Creative Concept Store—Clever Tool (3 sets), retrieved Mar. 22, 2018, 2 pages, <http://bibcreative.bigcartel.com/product/clever-tool-3-sets>.

(Continued)

*Primary Examiner* — Brian D Keller
(74) *Attorney, Agent, or Firm* — Dicke, Billig & Czaja, PLLC

(57) ABSTRACT

A multi-tool includes a pair of plates having respective handle portions, joint portions, and head portions, and the plates pivotally connected to each other at the joint portions and having respective opposite edges extended along the handle portions. At least one of the plates is to be pivoted relative to the other of the plates to establish an open position and a closed position of the plates, and, in the closed position of the plates, the plates to overlap each other and the opposite edges of the handle portions of the plates to be substantially aligned.

15 Claims, 39 Drawing Sheets

(51) Int. Cl.

| | |
|---|---|
| ***B25G 1/08*** | (2006.01) |
| ***B25B 7/22*** | (2006.01) |
| ***B25B 7/08*** | (2006.01) |
| ***B25B 7/02*** | (2006.01) |

(56) References Cited

U.S. PATENT DOCUMENTS

| | | | | |
|---|---|---|---|---|
| 4,336,652 | A † | 6/1982 | Robertson | |
| D288,893 | S | 3/1987 | Epstein | |
| 5,193,336 | A † | 3/1993 | King | |
| 5,255,438 | A † | 10/1993 | Morgan | |
| D358,536 | S | 5/1995 | Gore | |
| D416,178 | S | 11/1999 | Moore | |
| 6,185,771 | B1 * | 2/2001 | Trusty, Sr. | B25F 1/003 30/162 |
| D442,451 | S | 5/2001 | Berg | |
| D445,655 | S | 7/2001 | Maddox | |
| 6,804,869 | B1 | 10/2004 | Tong | |
| 7,346,986 | B2 | 3/2008 | Feith | |
| 7,587,963 | B1 † | 9/2009 | Broadus | |
| D613,138 | S | 4/2010 | Salvino | |
| 8,176,814 | B1 † | 5/2012 | Bernstein | |
| D666,883 | S | 9/2012 | Howard | |
| D689,351 | S | 9/2013 | Webb, Jr. | |
| D747,638 | S | 1/2016 | Hernandez | |
| D768,460 | S | 10/2016 | Adelman | |
| 9,457,460 | B2 † | 10/2016 | Hermansen | |
| D772,028 | S | 11/2016 | Tangreen | |
| 10,035,248 | B2 † | 7/2018 | Ichikawa | |
| D832,673 | S | 11/2018 | Berman | |
| D837,619 | S | 1/2019 | George | |
| D842,067 | S | 3/2019 | Young | |
| D848,808 | S | 5/2019 | Zhong | |
| D878,890 | S | 3/2020 | Riehl | |
| 2010/0293721 | A1 * | 11/2010 | James | B25B 13/04 7/138 |
| 2016/0082793 | A1 | 3/2016 | Davidson | |
| 2017/0157757 | A1 † | 6/2017 | Winefordner | |
| 2017/0348830 | A1 † | 12/2017 | Lazenby | |
| 2018/0093369 | A1 | 4/2018 | Ichikawa | |
| 2019/0061126 | A1 † | 2/2019 | Park | |
| 2019/0275651 | A1 | 9/2019 | Dittmer | |

FOREIGN PATENT DOCUMENTS

| | | |
|---|---|---|
| TW | M505986 | 8/2015 |
| TW | 201634194 | 10/2016 |
| TW | M536595 | 2/2017 |
| TW | M545025 | 7/2017 |
| TW | M545057 | 7/2017 |
| TW | M546272 | 8/2017 |
| TW | M546273 | 8/2017 |
| TW | M549279 | 9/2017 |
| TW | M549280 | 9/2017 |
| TW | M554399 | 1/2018 |
| TW | M554400 | 1/2018 |

OTHER PUBLICATIONS

Bikerumor Clever Standard Makes Quick Work of Re-using Chain Quick Links, Nov. 28, 2016, 3 pages, <https://www.bikerumor.com/2016/11/28/clever-standard-makes-quick-work-re-using-chain-quick-links/>.

KMC MissingLink Lever, retrieved Mar. 22, 2018, 1 page, <https://store.kmcchain.us/p/missinglink-lever>.

Moosetreks 2 in 1 Bike Tire Levers+Master Link Chain Pliers, retrieved Mar. 22, 2018, 10 pages, <https://www.amazon.com/Moosetreks-Levers-Premium-Engineering-Plastic/dp/B074QM8NK2>.

Park Tool Master Link Pliers MLP-1.2, retrieved Mar. 22, 2018, 2 pages, <https://www.parktool.com/product/master-link-pliers-mlp-1-2>.

Sumnacon Bike Tire Levers+Master Link Chain Pliers—Sumnacon 3 in 1 Multifunction Bicycle Tire Repair Tool, retrieved Mar. 22, 2018, 11 pages, <https://www.amazon.com/Bike-Levers-Master-Chain-Pliers/dp/B078HK9NPP/ref=sr_1_17?s=spo>.

* cited by examiner
† cited by third party

MULTI-TOOL

CROSS-REFERENCE TO RELATED APPLICATIONS

This application claims priority under 35 U.S.C. § 119(e) to U.S. Provisional Patent Application Ser. No. 62/641,585 filed on Mar. 12, 2018, and incorporated herein by reference.

BACKGROUND

The present disclosure relates generally to a multi-tool and, more specifically, relates to a multi-tool for use with a bicycle.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
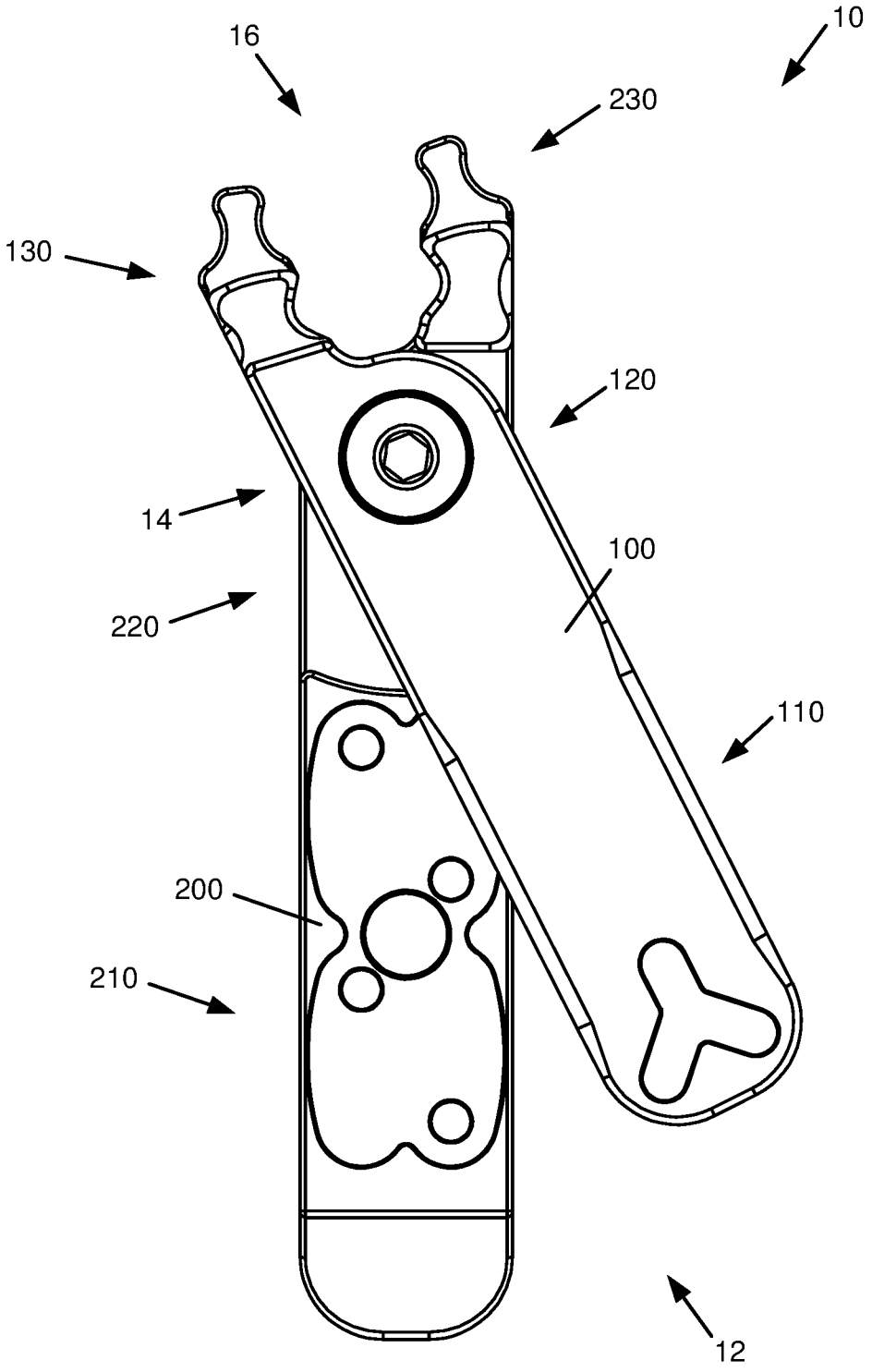
FIGS. 1 and 2 are front and rear views, respectively, of an example of a multi-tool in accordance with the present disclosure.
Figure 2:
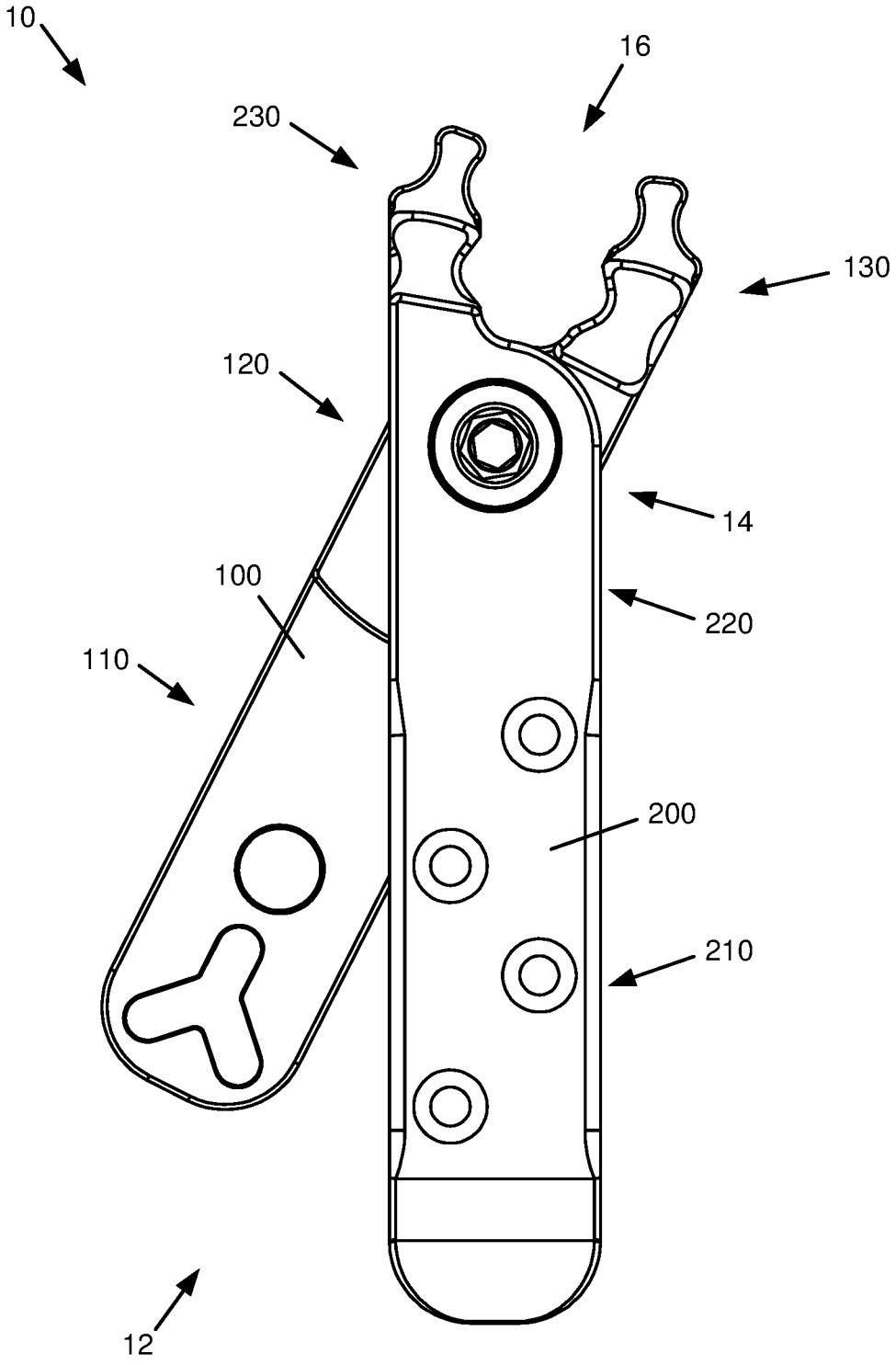

FIGS. 1 and 2 are front and rear views, respectively, of an example of a multi-tool 10. In one example, multi-tool 10 includes handles 12, joint 14, and head 16. As disclosed herein, handles 12 are pivotally connected at joint 14. As such, head 16 may be opened and/or closed (or expanded and/or retracted) by actuation of handles 12. In the illustrated example, multi-tool 10 is formed by a pair of plates 100 and 200, with plates 100 and 200 having respective handle portions 110 and 210, joint portions 120 and 220, and head portions 130 and 230.

Figure 3:
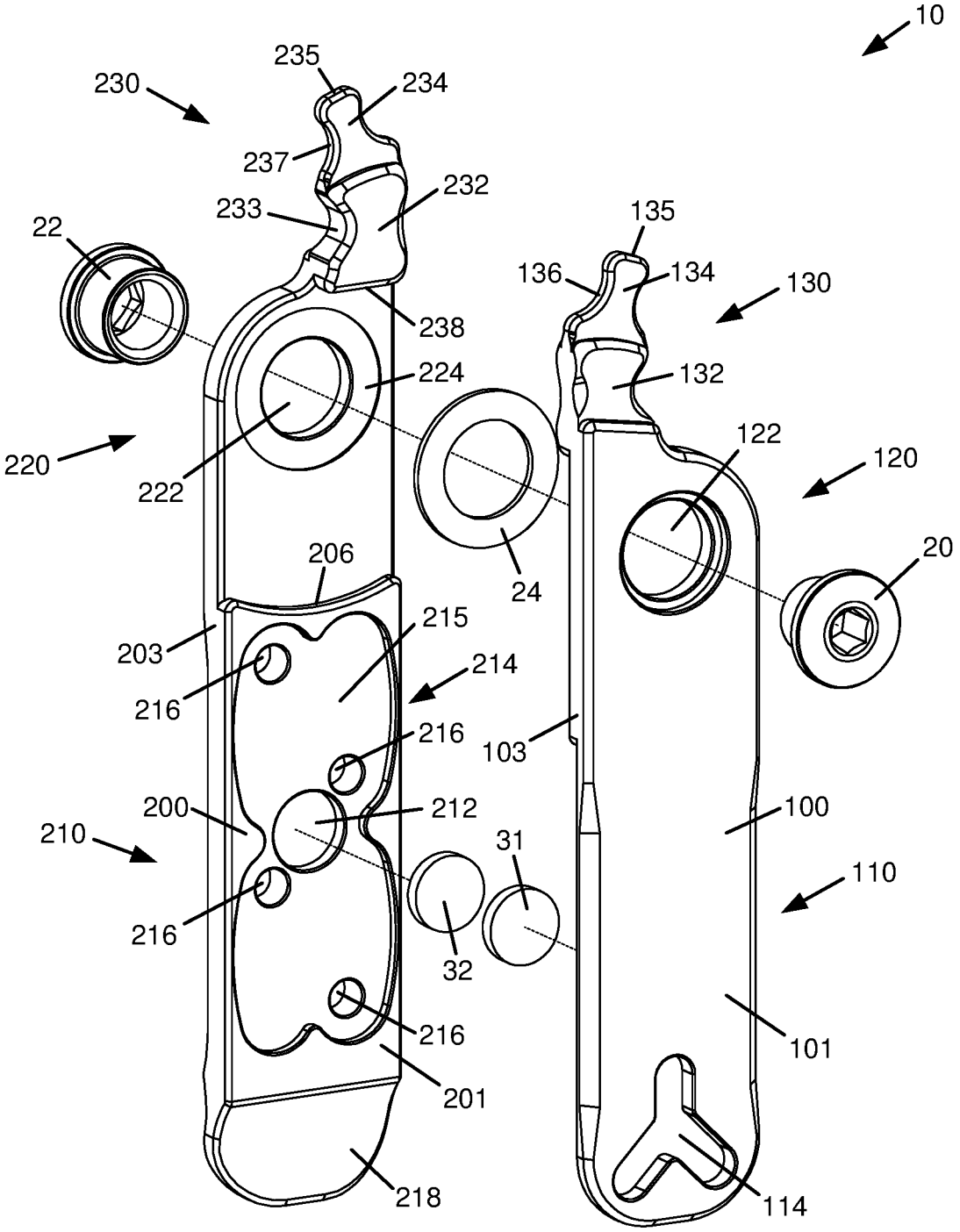
FIGS. 3 and 4 are exploded front perspective views of an example of the multi-tool of FIGS. 1 and 2.
Figure 4:
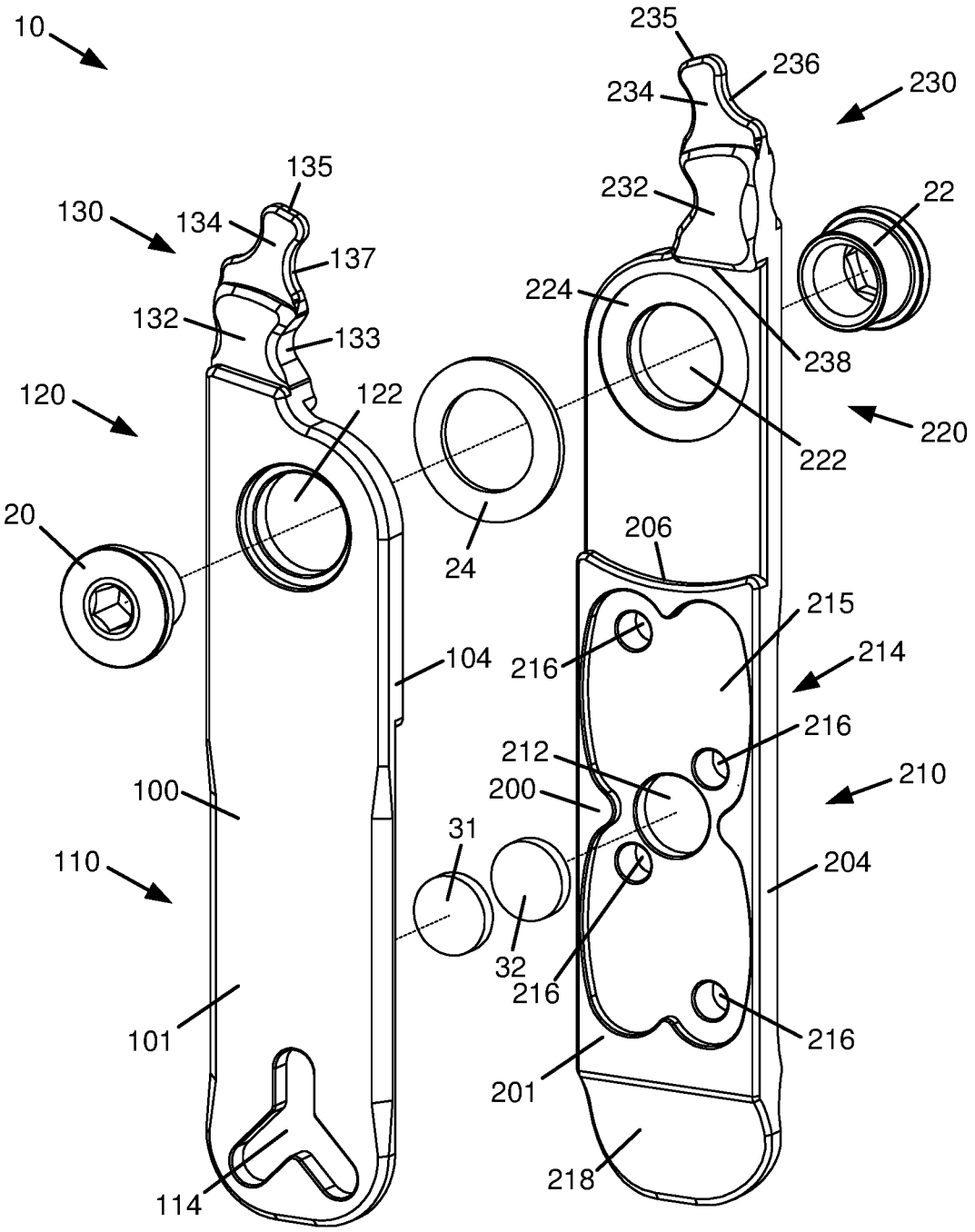
Figure 5:
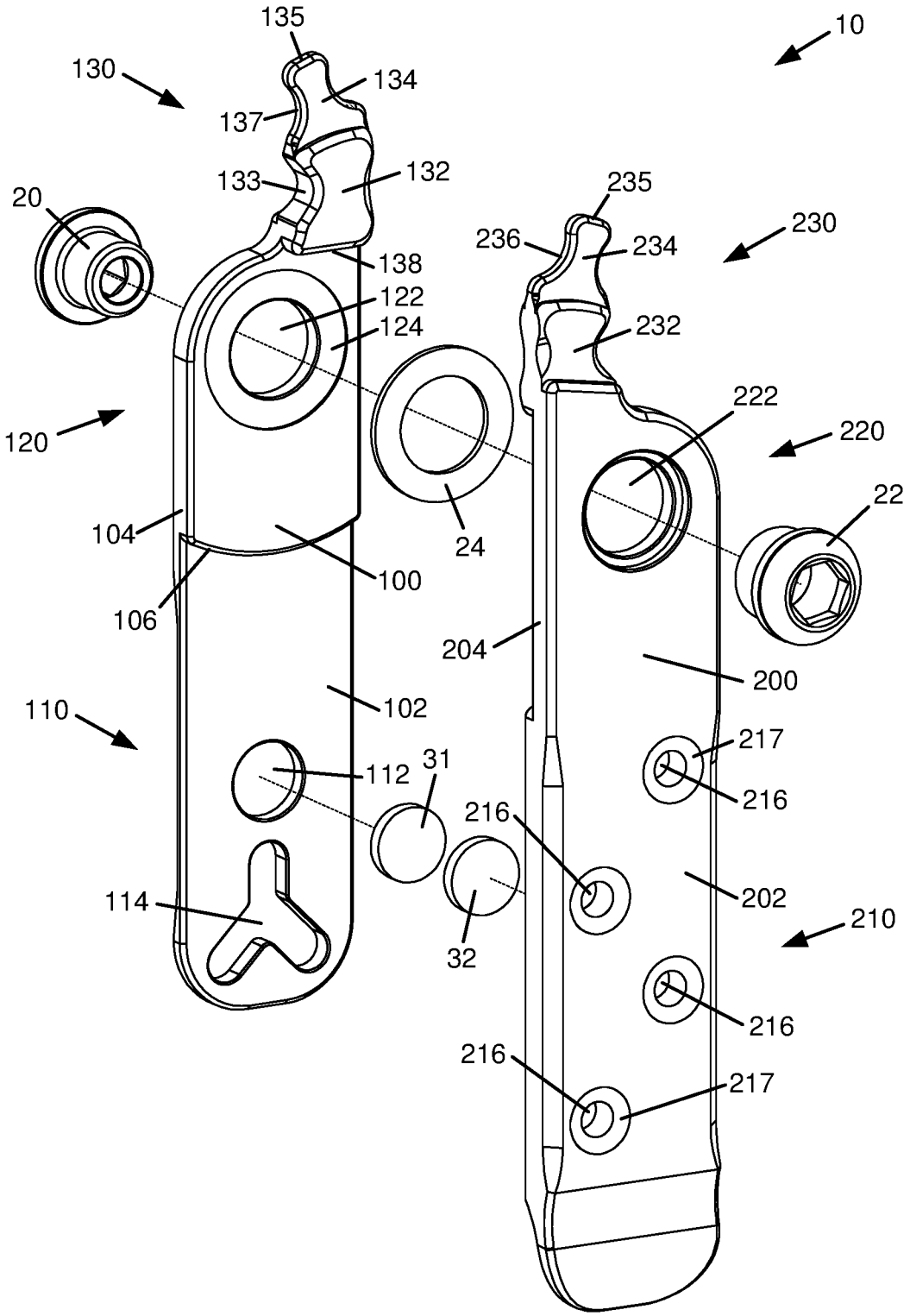
FIGS. 5 and 6 are exploded rear perspective views of an example of the multi-tool of FIGS. 1 and 2.
Figure 6:
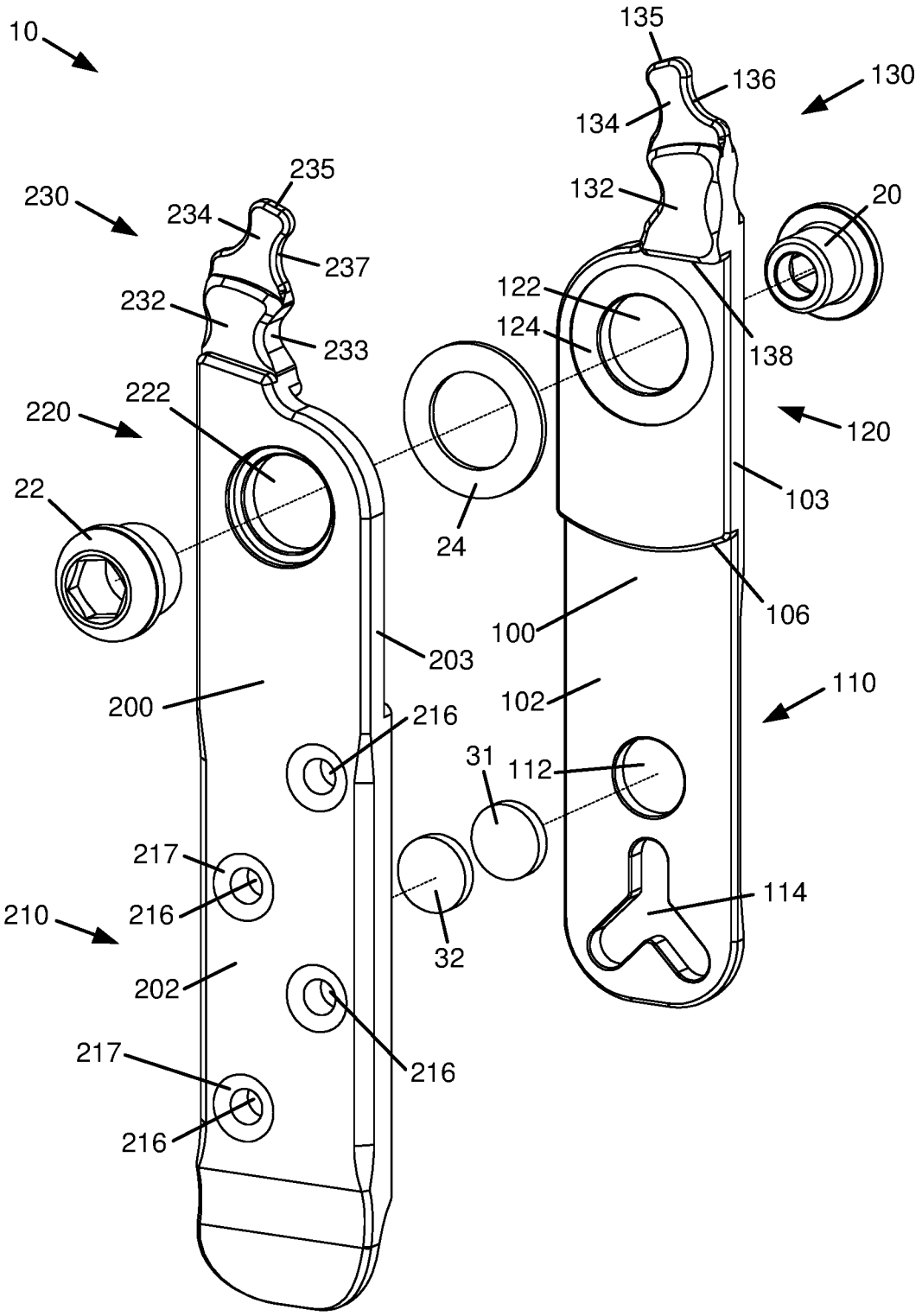

FIGS. 3 and 4 are exploded front perspective views of multi-tool 10, and FIGS. 5 and 6 are exploded rear perspective views of multi-tool 10. In one implementation, plate 100 has opposite sides 101 and 102, and opposite edges 103 and 104, and plate 200 has opposite sides 201 and 202, and opposite edges 203 and 204. In one implementation, edges 103 and 104 and edges 203 and 204 extend along respective handle portions 110 and 210 and respective joint portions 120 and 220 of respective plates 100 and 200.

As disclosed herein, plates 100 and 200 are pivotally connected such that sides 102 and 201 of respective plates 100 and 200 oppose or face each other in a closed position. In one example, in the closed position, plates 100 and 200 nest or overlap with each other. As such, edges 103 and 203 of respective plates 100 and 200 are substantially aligned, and edges 104 and 204 of respective plates 100 and 200 are substantially aligned (see, e.g., FIG. 7). In one example, handle portions 110 and 210 of respective plates 100 and 200 are each of a generally rectangular shape and, in one implementation, include rounded corners and/or beveled and/or rounded edges.

In one implementation, a thickness T1 of handle portion 110 of plate 100 is less than a thickness T2 of joint portion 120 of plate 100 (see, e.g., FIG. 25) such that a shoulder 106 is formed on side 102 of plate 100. In addition, in one implementation, a thickness T3 of joint portion 220 of plate 200 is less than a thickness T4 of handle portion 210 of plate 200 (see, e.g., FIG. 23) such that a shoulder 206 is formed on side 201 of plate 200.

In the illustrated example, joint 14 includes a bolt 20 and a nut 22. In addition, in one implementation, joint portions 120 and 220 of respective plates 100 and 200 have respective and corresponding holes 122 and 222 formed therethrough. As such, in one implementation, bolt 20 and/or nut 22 extend into and/or pass through holes 122 and 222, and are threaded together to pivotally couple plates 100 and 200. In one implementation, bolt 20 is a chainring bolt and nut 22 is a T-nut. As such, bolt 20 and/or nut 22 may be used to replace a chainring bolt and/or nut on a bicycle.

In one implementation, joint 14 includes a washer 24 interposed between joint portions 120 and 220 of respective plates 100 and 200. As such, washer 24 helps to space apart or position plates 100 and 200 relative to each other and provides a bearing surface for pivotal movement of plates 100 and 200 relative to each other. In one implementation, washer 24 is fit within corresponding and respective recesses 124 and 224 formed within respective joint portions 120 and 220 concentric with respective holes 122 and 222. In one example, washer 24 is formed of a polymer material, including, for example, an acetal, such as Delrin, or a polyamide, such as Nylon.

In the illustrated example, head portions 130 and 230 extend from an end of respective plates 100 and 200. In one implementation, head portions 130 and 230 each have respective jaw sections 132 and 232 and respective tips 134 and 234. Jaw sections 132 and 232 oppose each other and, as disclosed herein, together form gripping jaws 18 of multi-tool 10 (see, e.g., FIG. 27). In one implementation, jaw sections 132 and 232 include respective and opposing gripping surfaces 133 and 233 (see also FIG. 27). In one example, gripping surfaces 133 and 233 each have a concave shape, including, for example, a concave arcuate shape, a U-shape, or a V- or shallow V-shape.

In one example, tips 134 and 234 are configured to disengage and/or engage or remove and/or install a chain link of a roller chain, such as a master link for a roller chain of a bicycle, including, for example, a Quick-Link by Shimano. More specifically, as disclosed herein, tips 134 and 234 are sized and shaped such that tips 134 and 234 may engage teeth receiving openings formed by spaced link plates of a roller chain. In one implementation, tips 134 and 234 are sized and shaped as single or individual teeth. As such, tips 134 and 234 have respective ends 135 and 235 and respective faces or engaging surfaces 136, 137 and 236, 237 (see also FIG. 27). In one example, engaging surfaces 136, 137 and 236, 237 each have a concave shape, including, for example, a concave arcuate shape.

In the illustrated example, head portions 130 and 230 of respective plates 100 and 200 include respective shoulders 138 and 238. In one implementation, as disclosed herein, shoulders 138 and 238 limit or stop rotation of plates 100 and 200 relative to each other.

In one example, handles 12 are magnetically attracted to each other. More specifically, in one implementation, handle portions 110 and 210 include respective magnetic elements 31 and 32. As such, as disclosed herein, magnetic elements 31 and 32 provide a magnetic closure to and magnetically couple handle portions 110 and 210 of respective plates 100 and 200.

In one example, magnetic elements 31 and 32 are attached to, secured to, or positioned on or in opposing sides of respective handle portions 110 and 210. For example, magnetic element 31 of handle portion 110 is attached to, secured to, or positioned on or in side 102 of plate 100, and magnetic element 32 of handle portion 210 is attached to, secured to, or positioned on or in side 201 of plate 200. In the illustrated example, magnetic elements 31 and 32 are attached to, secured to, or positioned on or in opposing sides of respective handle portions 110 and 210 within respective recesses or cavities 112 and 212.

In one example, magnetic element 32 is or includes a magnet, and magnetic element 31 is or includes a magnet or is or includes an element (i.e., keeper) formed of a material to which a magnet may be attracted (e.g., a ferrous material). Magnetic elements 31 and 32 each may be a disk, plate, strip, or sheet, and each may be of a circular, rectangular, or other shape.

In one implementation, handle portion 210 of plate 200 includes a storage area 214. In the illustrated example, storage area 214 includes a recessed region 215 formed in side 201 of plate 200 and one or more than one hole 216 formed through plate 200 within recessed region 215. In one implementation, storage area 214 is configured to receive and store a chain link for a roller chain, such as a master link for a roller chain of a bicycle, including, for example, a Quick-Link by Shimano. More specifically, as disclosed herein, recessed region 215 is configured to receive and store a link plate of a roller chain and hole 216 is configured to receive a link pin extended from the link plate.

In one example, hole 216 includes a corresponding recess 217 at side 202 of plate 200. In one example, recess 217 includes a countersink, counterbore, spot face or other recess. In one implementation, recess 217 includes a spherical countersink. In other examples, recess 217 may include a beveled or chamfered countersink.

In one example, recessed region 215 includes an array of recessed regions 215 and corresponding holes 216 each configured to receive a respective link plate and corresponding link pin. In one implementation, the array of recessed regions 215 are contiguous and the corresponding holes 216 are staggered. In the illustrated example, the array of recessed regions 215 and corresponding holes 216 includes four recessed regions 215 and four corresponding holes 216 configured to receive two chain links (i.e., two pairs (or two sets) of mating chain link plates).

In the illustrated example, handle portion 210 of plate 200 includes a dished section 218 formed at or extended from an end of handle portion 210. As such, in one implementation, handle portion 210 may be used as a tire lever. More specifically, as disclosed herein, dished section 218 may be used as a tire lever spoon for removing a tire from and/or installing a tire on a wheel rim, such as a wheel rim of a bicycle.

In the illustrated example, handle portion 110 of plate 100 has an opening 114 formed therethrough at or adjacent an end of handle portion 110. As such, in one implementation, handle portion 110 may be used as a wrench. More specifically, as disclosed herein, opening 114 is sized and shaped such that handle portion 110 may be used as a tool for loosening and/or tightening or removing and/or installing a valve core of a valve stem of an inner tube or a wheel rim, such as an inner tube or a wheel rim of a bicycle. In one implementation, opening 114 is an enclosed opening. In one implementation, opening 114 is Y-shaped. In one example, each leg or arm of the Y-shape may be used as a wrench.

Figure 7:
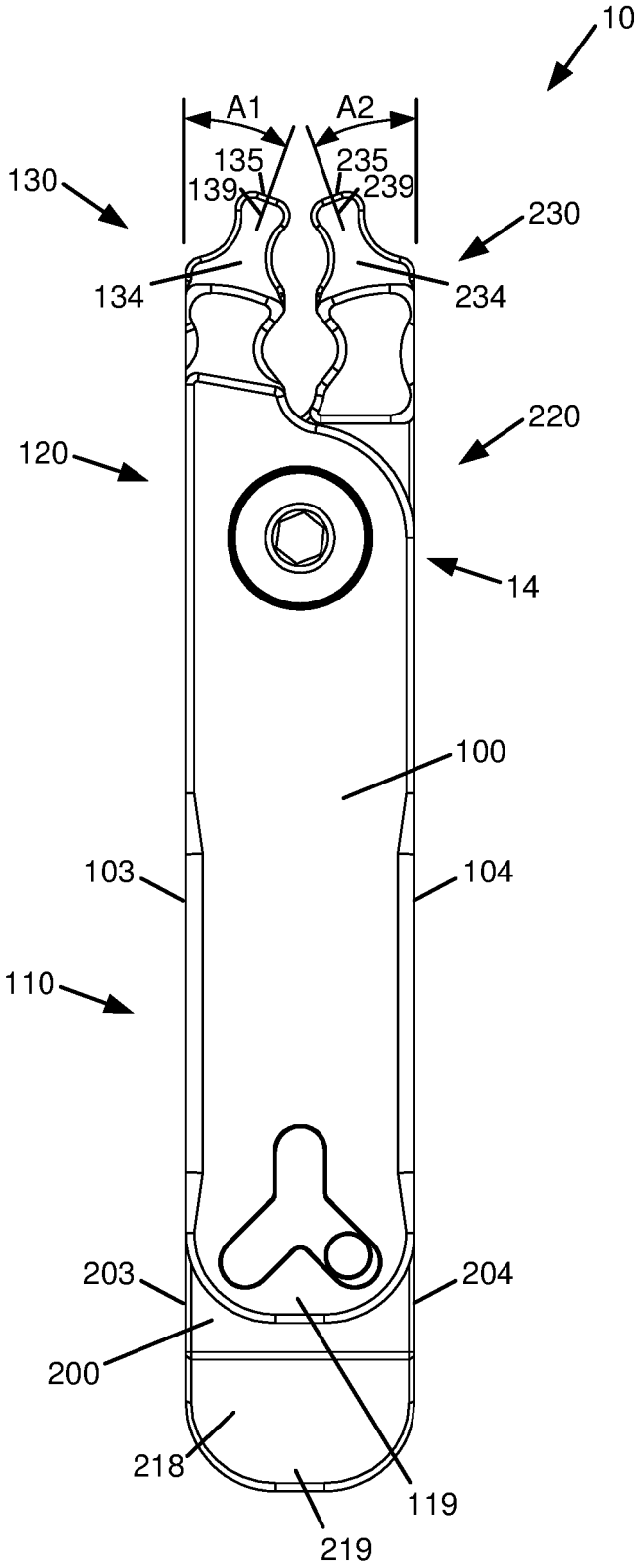
FIGS. 7 and 8, 9 are front and front perspective views, respectively, of the multi-tool of FIGS. 1 and 2 in a closed position.
Figure 8:
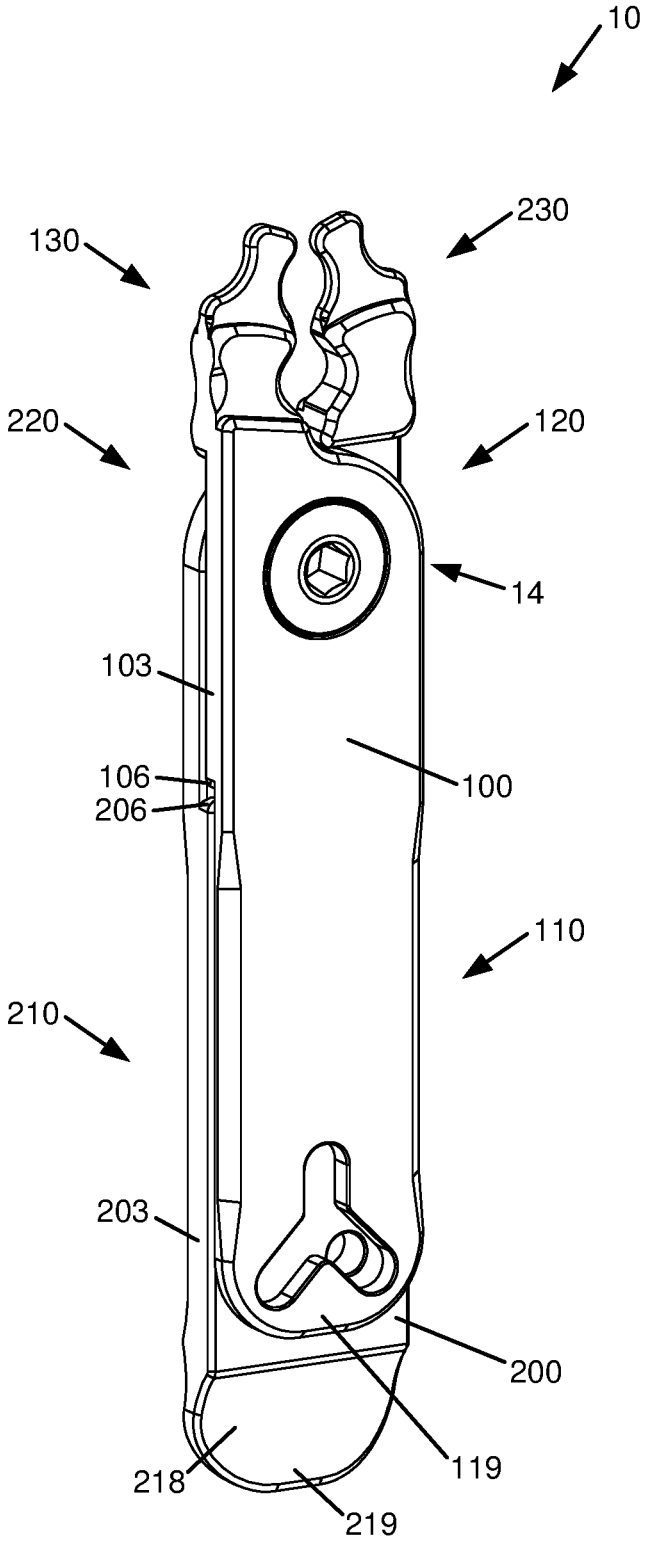
Figure 9:
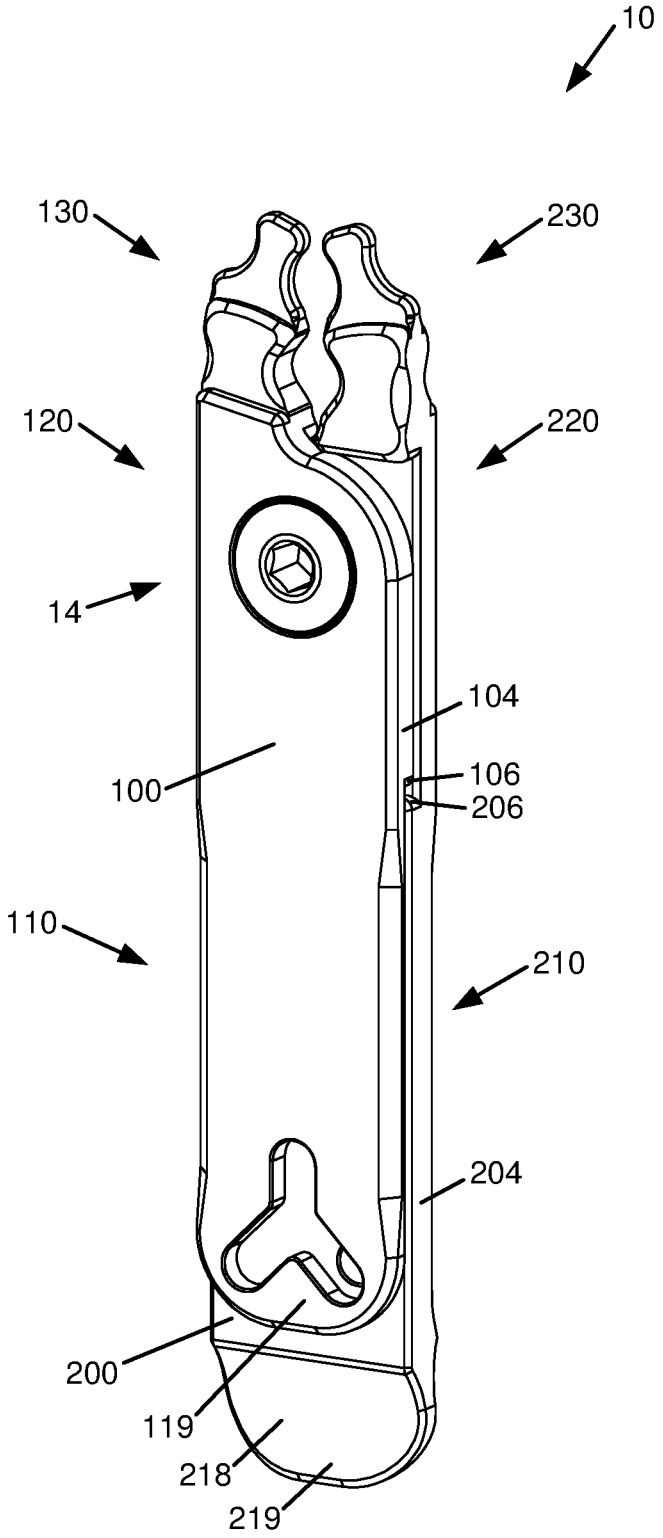
Figure 10:
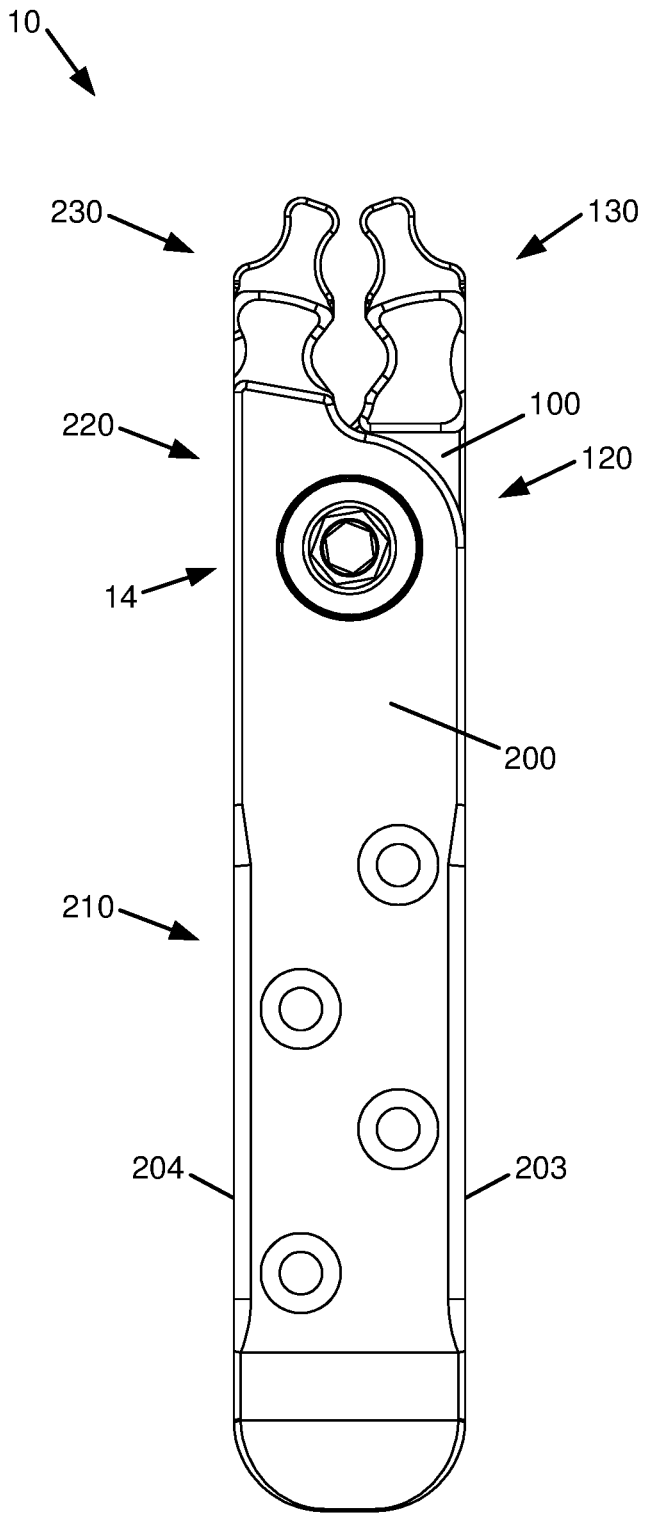
FIGS. 10 and 11, 12 are rear and rear perspective views, respectively, of the multi-tool of FIGS. 1 and 2 in a closed position.
Figure 11:
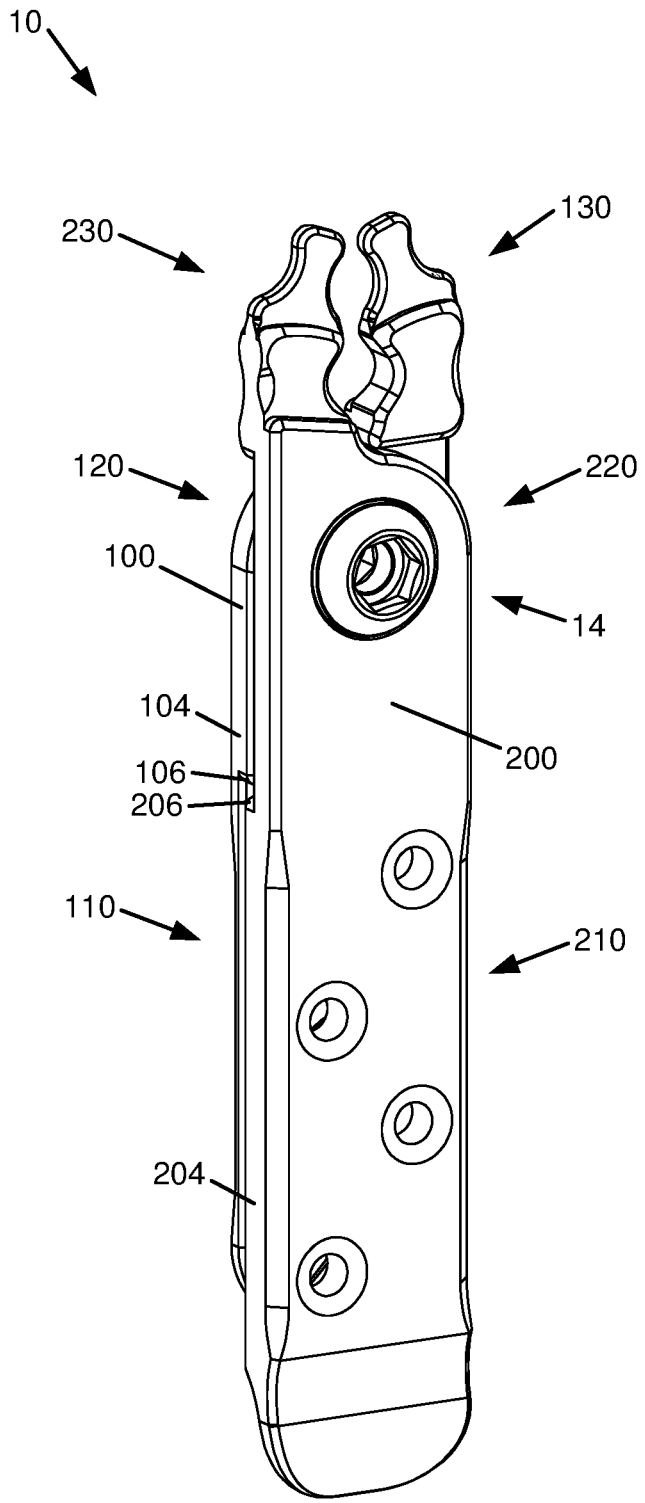
Figure 12:
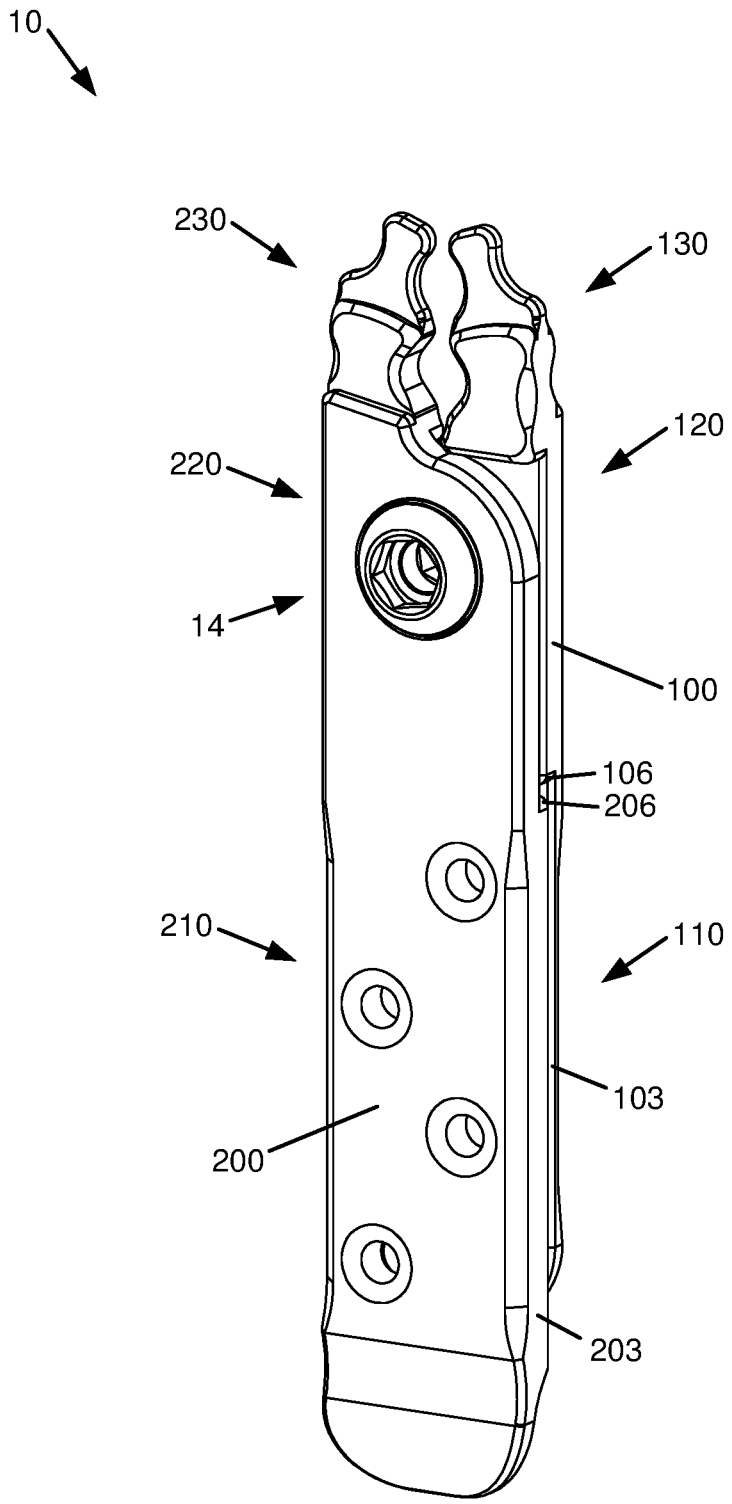
Figure 13:
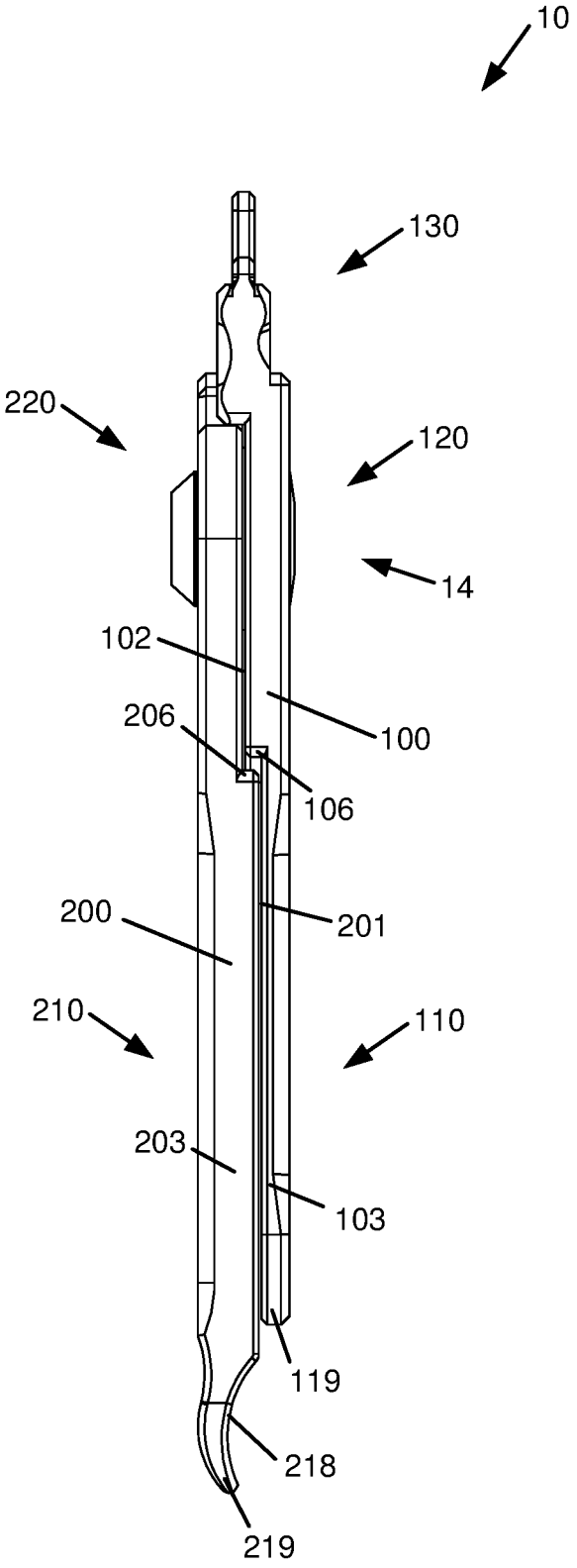
FIGS. 13 and 14 are side views of the multi-tool of FIGS. 1 and 2 in a closed position.
Figure 14:
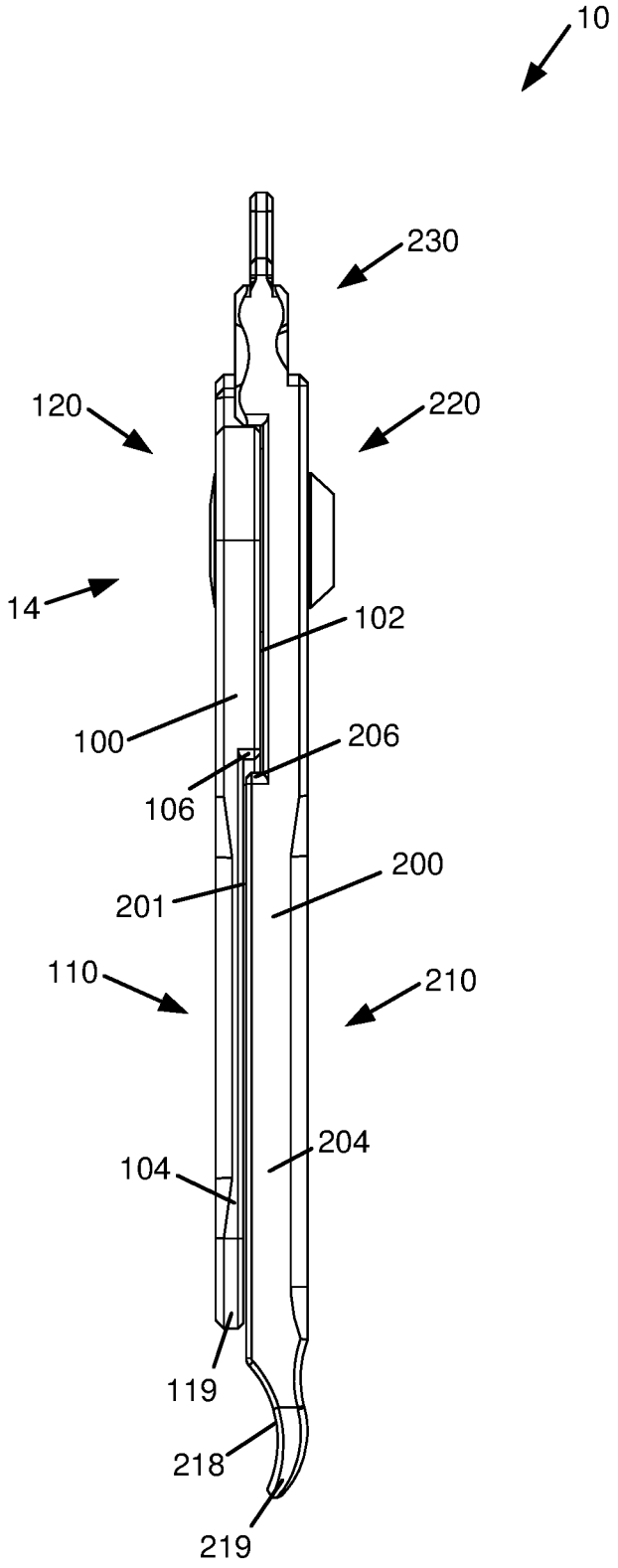
Figure 15:
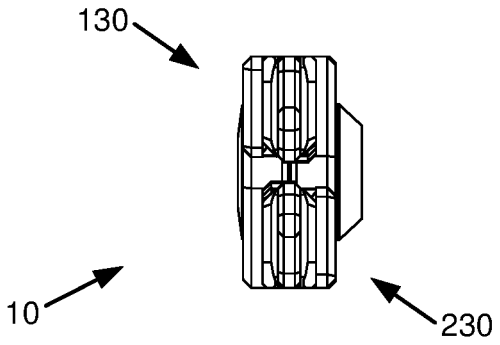
FIGS. 15 and 16 are top and bottom views, respectively, of the multi-tool of FIGS. 1 and 2 in a closed position.
Figure 16:
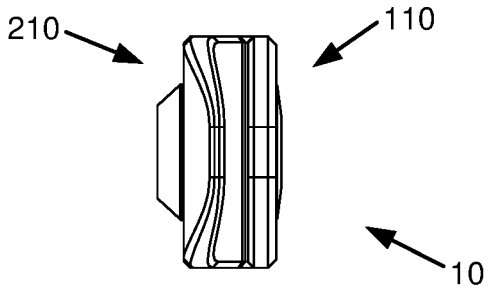

FIGS. 7 and 8, 9 are front and front perspective views, respectively, of multi-tool 10 in a closed position, and FIGS. 10 and 11, 12 are rear and rear perspective views, respectively, of multi-tool 10 in a closed position. In addition, FIGS. 13 and 14 are side views of multi-tool 10 in a closed position, and FIGS. 15 and 16 are top and bottom views, respectively, of multi-tool 10 in a closed position.

In the illustrated example, in the closed position, plates 100 and 200 nest or overlap with each other. More specifically, in the closed position, edges 103 and 203 and edges 104 and 204 of respective plates 100 and 200, as extended along respective handle portions 110 and 210 and extended along respective joint portions 120 and 220, are substantially aligned with each other.

In one implementation, tips 134 and 234 of respective head portions 130 and 230 are oriented at an angle relative to respective plates 100 and 200. More specifically, in one example, axes 139 and 239, extended through ends 135 and 235 of respective tips 134 and 234, are oriented at respective angles A1 and A2 relative to edges 103 and 204 of respective plates 100 and 200.

In one implementation, plates 100 and 200 are pivotally coupled at joint 14 such that joint portions 120 and 220 overlap with each other. More specifically, in one example, shoulders 106 and 206 are correspondingly positioned on sides 102 and 201 of respective plates 100 and 200, and plates 100 and 200 are pivotally coupled, such that, in a closed position of multi-tool 10, joint portions 120 and 220 nest with each other.

In the illustrated example, in the closed position, plate 200 extends beyond plate 100. More specifically, an end 219 of handle portion 210 of plate 200 extends beyond an end 119 of handle portion 110 of plate 100. As such, in one example, in the closed position, dished section 218 of handle portion 210 extends beyond end 119 of plate 100.

Figure 17:
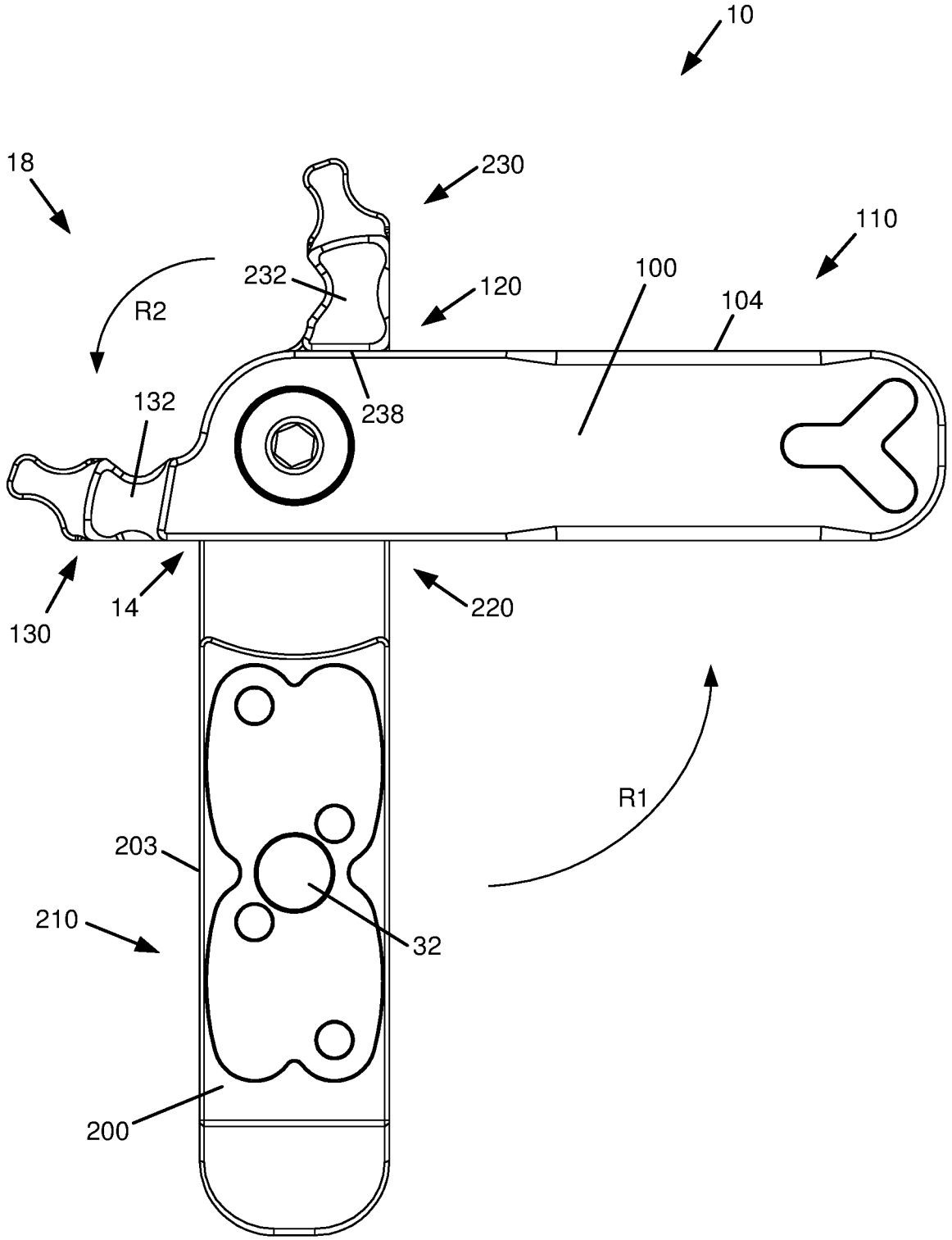
FIGS. 17 and 18, 19 are front and front perspective views, respectively, of the multi-tool of FIGS. 1 and 2 in an open position.
Figure 18:
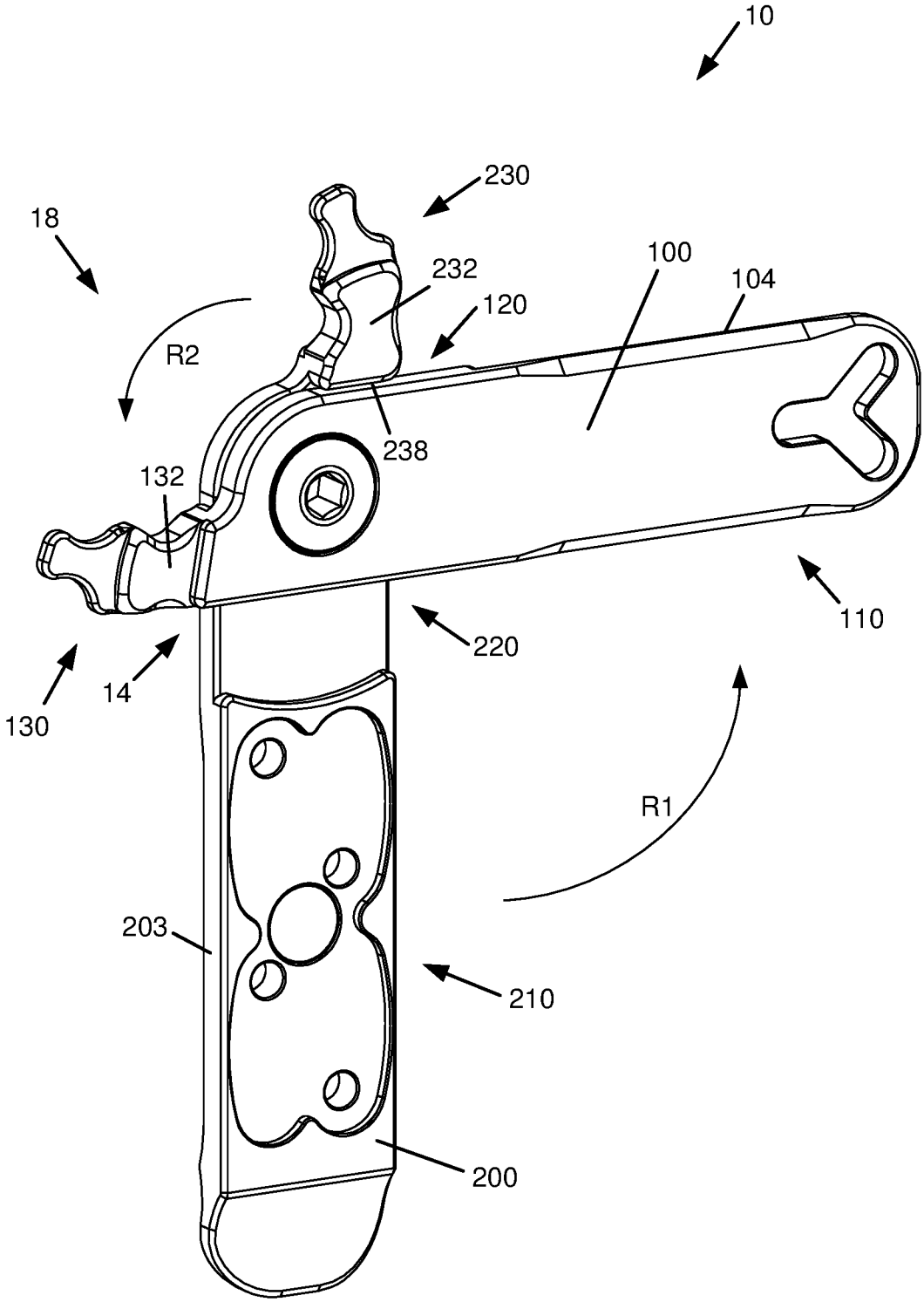
Figure 19:
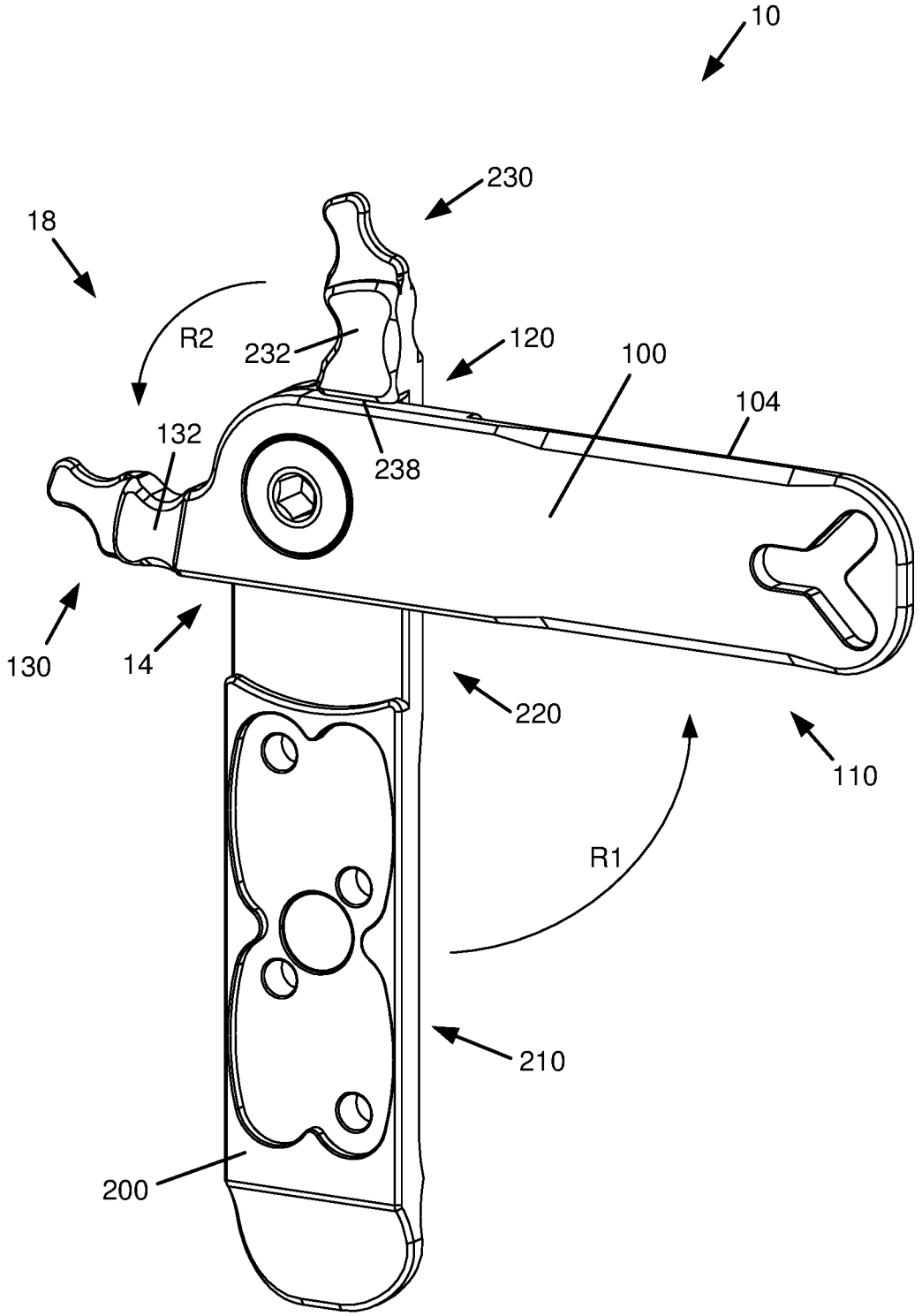
Figure 20:
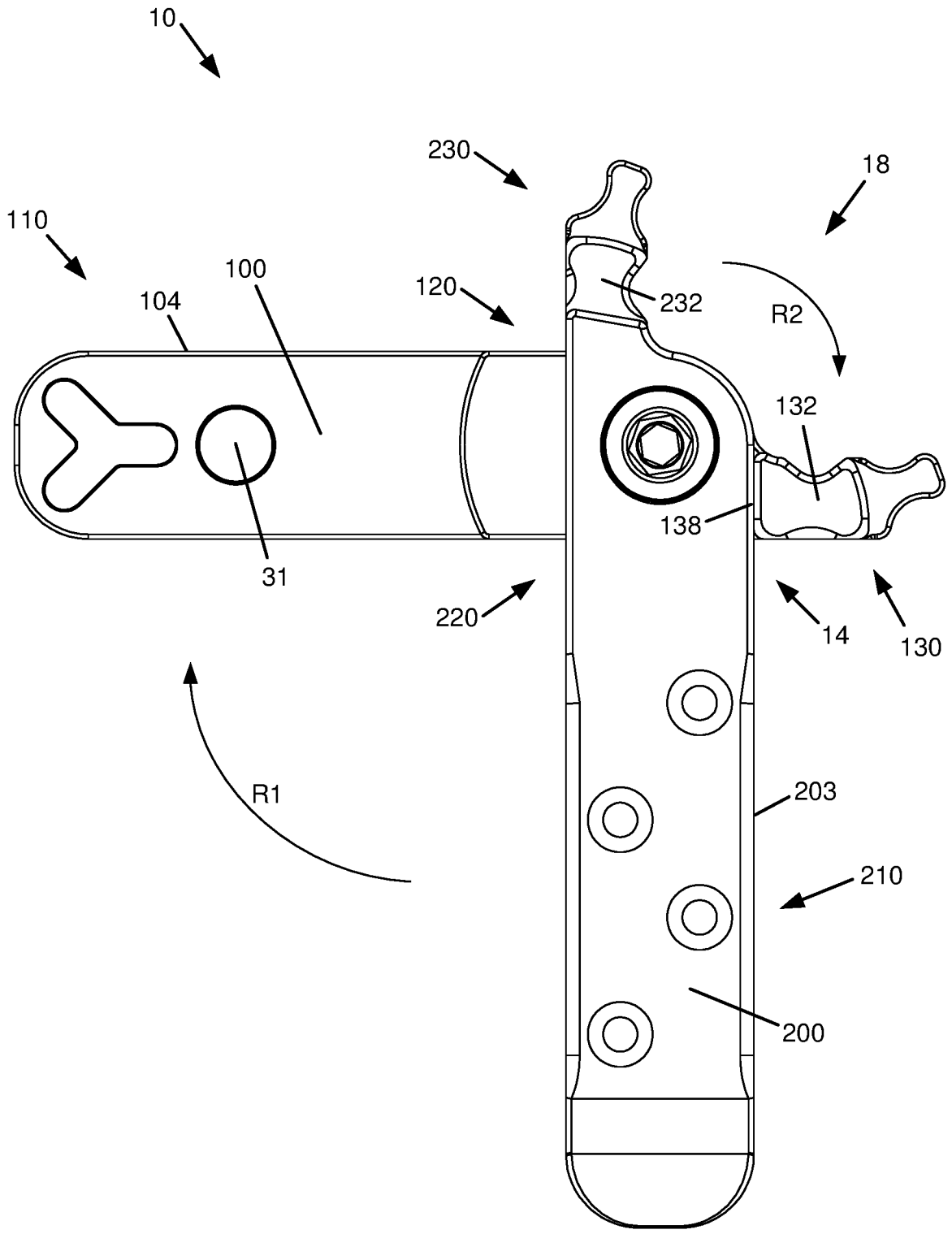
FIGS. 20 and 21, 22 are rear and rear perspective views, respectively, of the multi-tool of FIGS. 1 and 2 in an open position.
Figure 21:
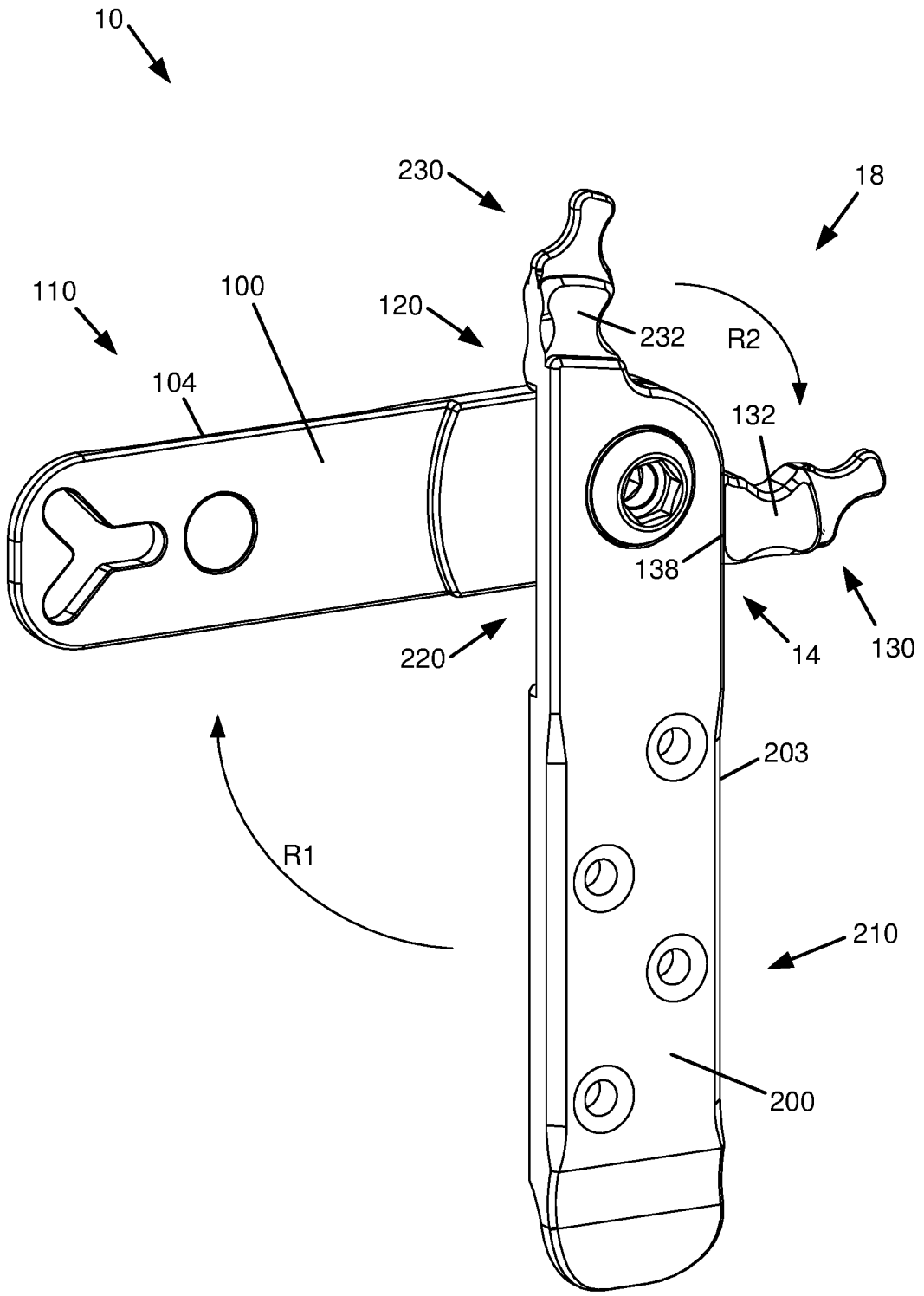
Figure 22:
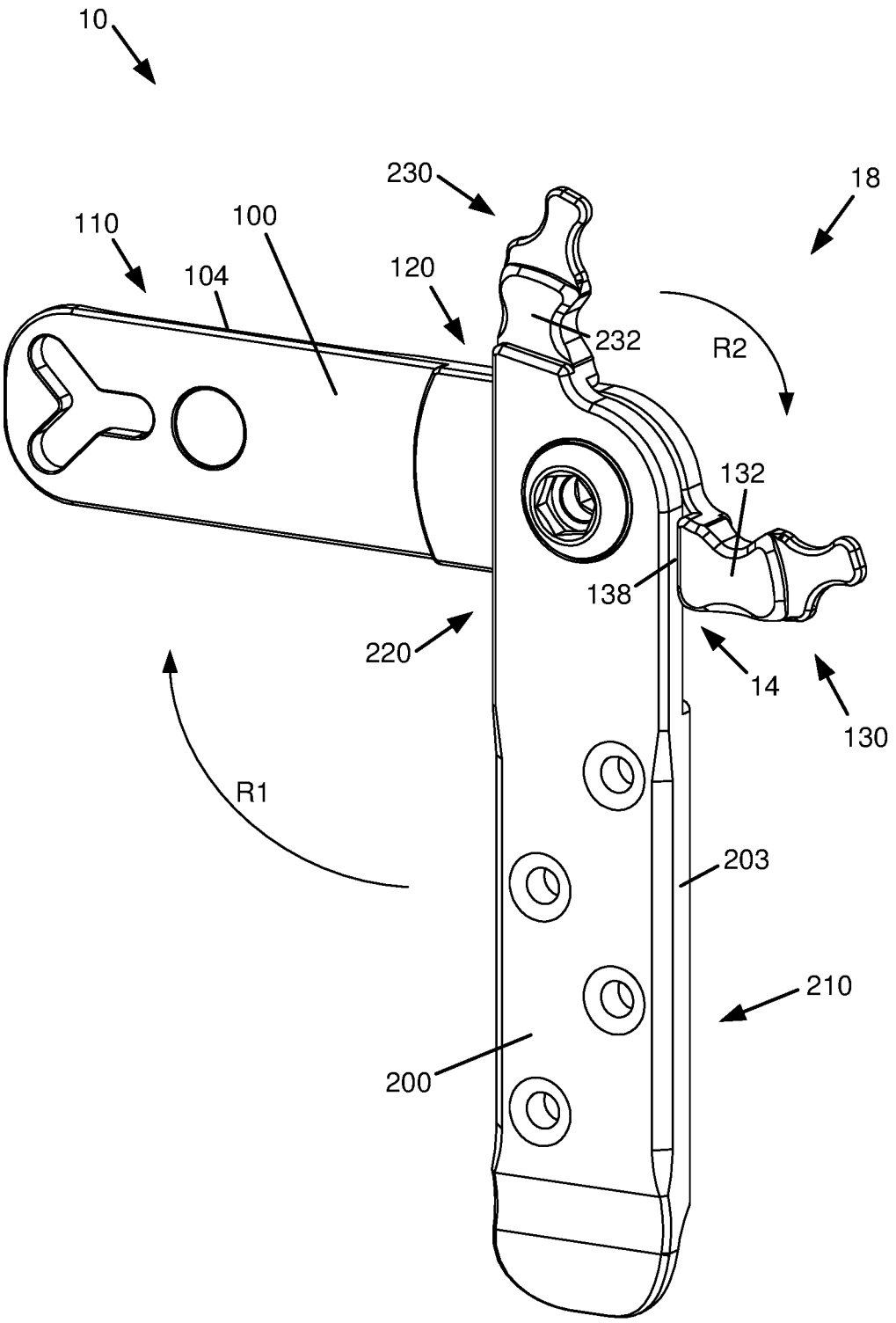
Figure 23:
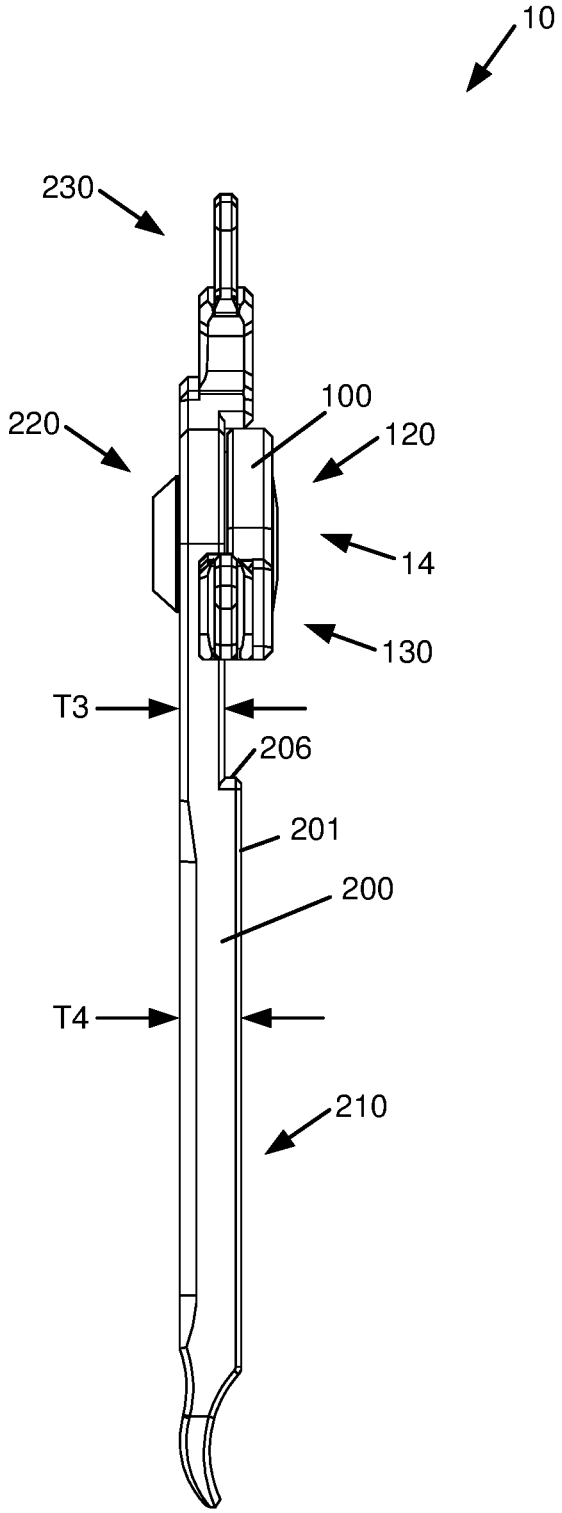
FIGS. 23 and 24 are side views of the multi-tool of FIGS. 1 and 2 in an open position.
Figure 24:
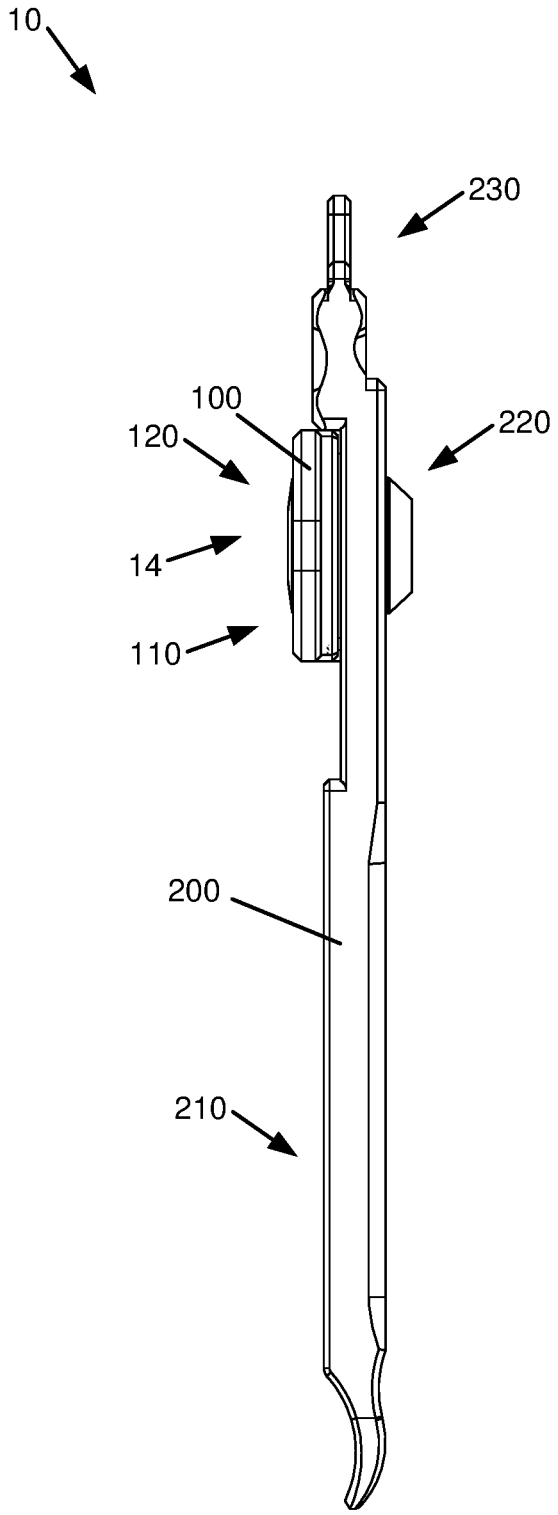
Figure 25:
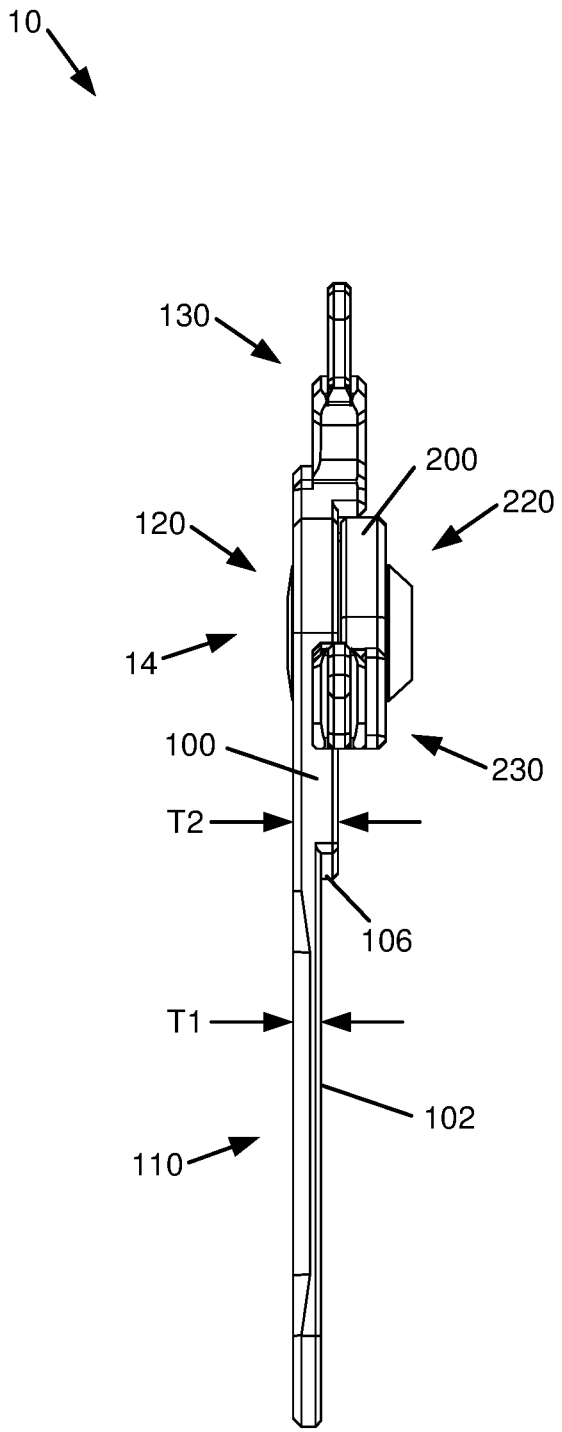
FIGS. 25 and 26 are top and bottom views, respectively, of the multi-tool of FIGS. 1 and 2 in an open position.
Figure 26:
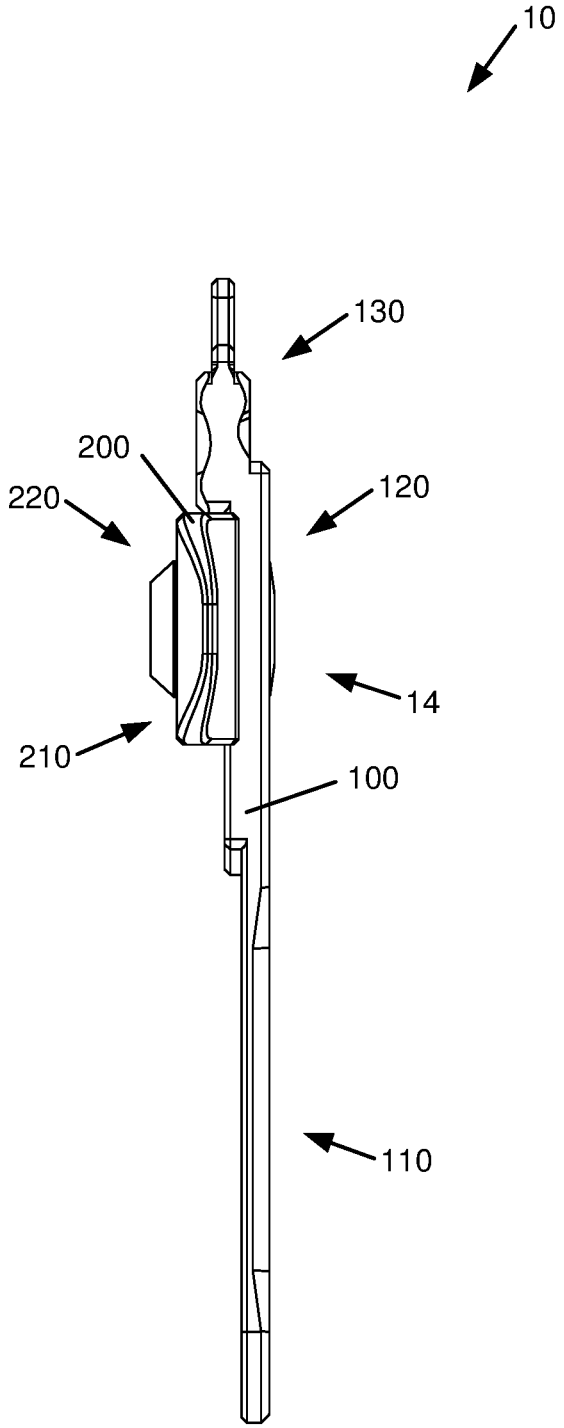

FIGS. 17 and 18, 19 are front and front perspective views, respectively, of multi-tool 10 in an open position, and FIGS. 20 and 21, 22 are rear and rear perspective views, respectively, of multi-tool 10 in an open position. In addition, FIGS. 23 and 24 are side views of multi-tool 10 in an open position, and FIGS. 25 and 26 are top and bottom views, respectively, of multi-tool 10 in an open position.

In the illustrated example, from a closed position to an open position, handle portion 110 of plate 100 is rotated or pivoted relative to handle portion 210 of plate 200 about joint 14. More specifically, handle portion 110 of plate 100 is pivoted, for example, away from handle portion 210 of plate 200, as represented by arrow R1. As such, jaw section 132 of head portion 130 is pivoted relative to jaw section 232 of head portion 230. More specifically, jaw section 132 of head portion 130 is pivoted, for example, away from jaw section 232 of head portion 230, as represented by arrow R2. Thus, in the illustrated example, gripping jaws 18 are in an example of an open position. In an open position, gripping jaws 18 may be used to grip or hold an object, for example, a bolt, nut, or other object.

In the illustrated example, handle portion 110 of plate 100 is pivoted relative to handle portion 210 of plate 200 by approximately 90 degrees of rotation. As such, jaw section 132 of head portion 130 is pivoted relative to jaw section 232 of head portion 230, by approximately 90 degrees of rotation. In other examples, handle portion 110 of plate 100 may be pivoted relative to handle portion 210 of plate 200 by other degrees of rotation including, for example, degrees of rotation between approximately 0 degrees and approximately 90 degrees. In addition, in examples, handle portion 110 of plate 100 may be pivoted relative to handle portion 210 of plate 200 by greater than 90 degrees of rotation. Although handle portion 110 of plate 100 is illustrated as being pivoted relative to handle portion 210 of plate 200, handle portion 210 of plate 200 may be pivoted relative to handle portion 110 of plate 100, or handle portion 110 of plate 100 and handle portion 210 of plate 200 may both be pivoted relative to each other.

In one implementation, shoulders 138 and 238 of respective head portions 130 and 230 provide stops to limit pivoting or rotation of plates 100 and 200 relative to each other. For example, in the illustrated example, edge 104 of plate 100 engages or contacts shoulder 238 of plate 200 and/or edge 203 of plate 200 engages or contacts shoulder 138 of plate 100 such that rotation of plates 100 and 200 relative to each other is limited or stopped.

Figure 27:
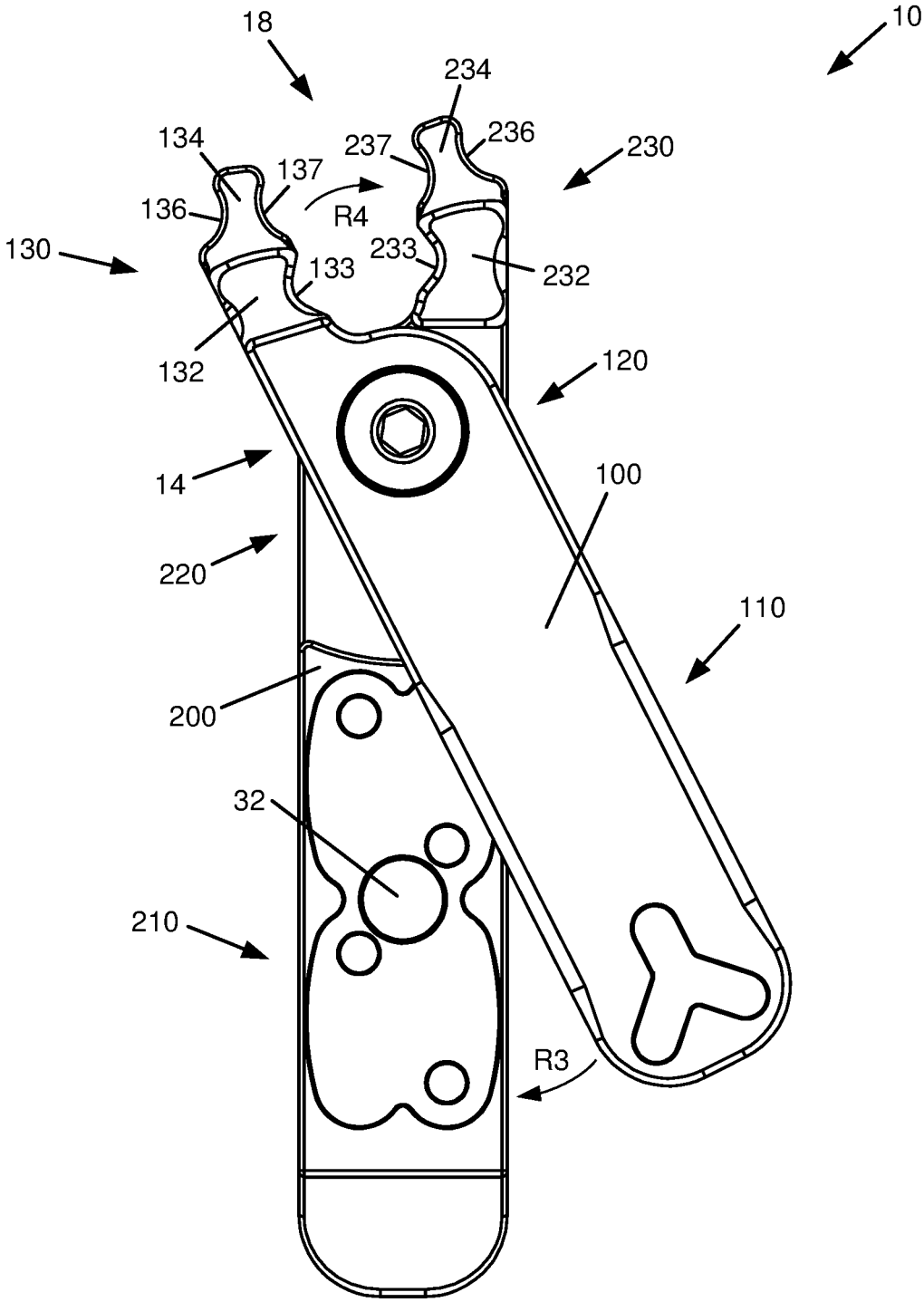
FIG. 27 is a front view of the multi-tool of FIGS. 1 and 2 in an example of a position between the open position of FIG. 17 and the closed position of FIG. 7.

FIG. 27 is a front view of multi-tool 10 in an example of a position between the open position of FIG. 17 and the closed position of FIG. 7. In the illustrated example, from the open position of FIG. 17, handle portion 110 of plate 100 is pivoted relative to handle portion 210 of plate 200, for example, toward handle portion 210 of plate 200, as represented by arrow R3. As such, jaw section 132 of head portion 130 of plate 100 is pivoted relative to jaw section 232 of the head portion 230 of plate 200, for example, toward jaw section 232, as represented by arrow R4. Thus, in the illustrated example, gripping jaws 18 are in another example of an open position. As such, gripping jaws 18 may be used to grip or hold an object, for example, a bolt, nut or other object.

In one example, as handle portion 110 of plate 100 and handle portion 210 of plate 200 are brought into proximity of each other, for example, as handle portion 110 of plate 100 is pivoted relative to handle portion 210 of plate 200 and toward the closed position of FIG. 7, magnetic elements 31 (see, e.g., FIG. 20) and 32 interact or attract each other to magnetically "pull" handle portion 110 of plate 100 to the closed position of FIG. 7. As such, in one example, magnetic elements 31 and 32 provide a magnetic closure and magnetically couple handle portions 110 and 210 of respective plates 100 and 200. In one example, magnetic elements 31 and 32 help to maintain the closed position of multi-tool 10 until an open position of multi-tool 10 is initiated (e.g., until handle portion 110 of plate 100 is pivoted or rotated away from handle portion 210 of plate 200, as illustrated, for example, in FIG. 17).

FIGS. 28A, 28B, 28C and FIGS. 29A, 29B, 29C are front and front perspective views, respectively, illustrating an example of use of multi-tool 10. For example, multi-tool 10 may be used to disengage and/or engage or remove and/or install a chain link 50 of a roller chain 60, such as a master link for a roller chain of a bicycle, including, for example, a Quick-Link by Shimano. In one example, chain link 50 may be used to join or couple two ends of roller chain 60 so as to form an endless or continuous loop of roller chain 60.

In the illustrated example, roller chain 60 includes and/or is formed by alternating, overlapping pairs of laterally spaced link plates 62. In one example, alternating, overlapping pairs of spaced link plates 62 are pivotally interconnected by link pins 64 extended through cylindrical rollers 66 provided between spaced link plates 62 at overlapping, opposite ends of spaced link plates 62. As such, laterally spaced link plates 62 form alternating teeth receiving openings 68.

Figure 28A:
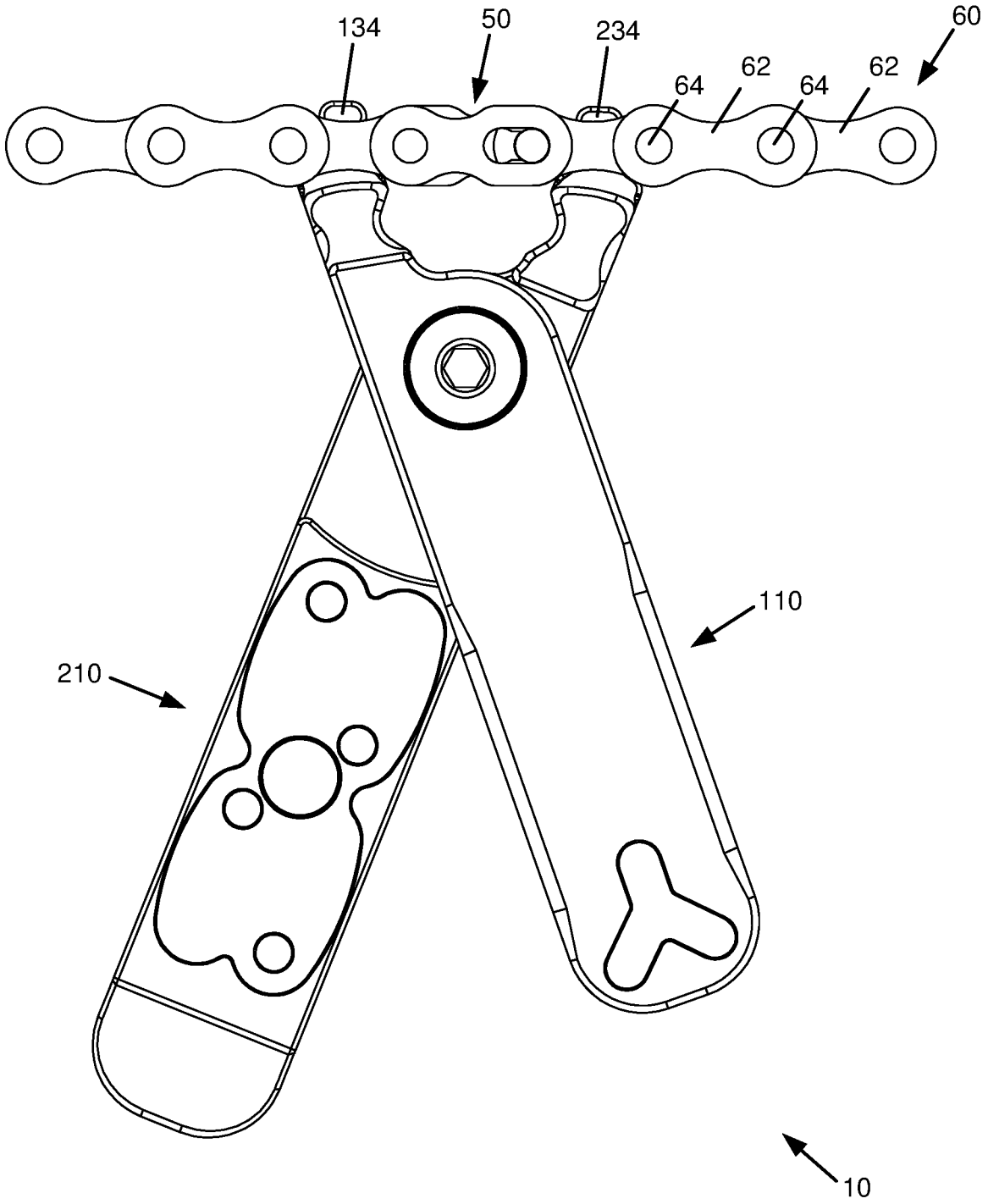
FIGS. 28A, 28B, 28C and FIGS. 29A, 29B, 29C are front and front perspective views, respectively, illustrating an example of use of the multi-tool of FIGS. 1 and 2.
Figure 29A:
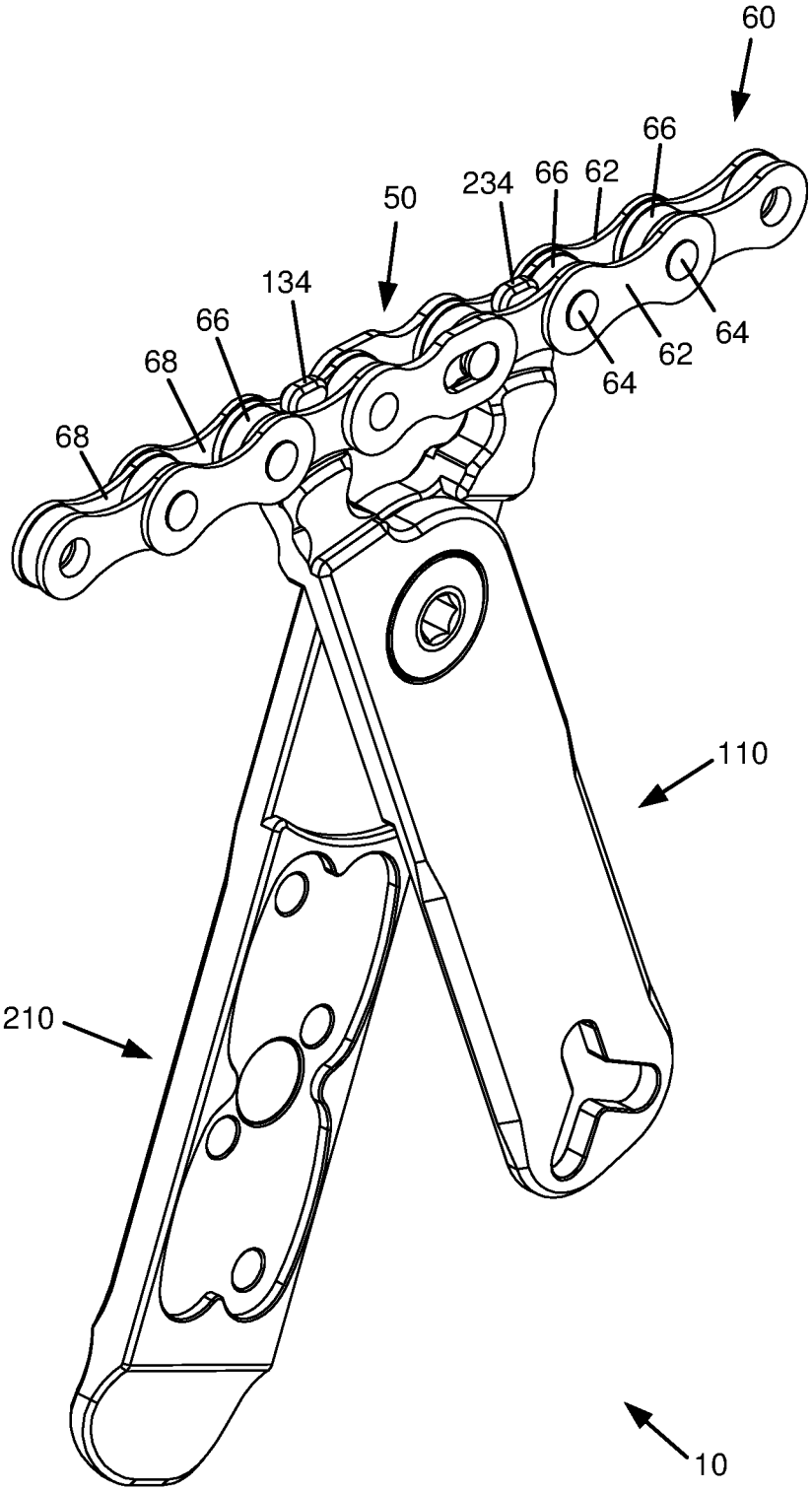

As illustrated in the example of FIGS. 28A and 29A, tips 134 and 234 of multi-tool 10 engage a section of roller chain 60. More specifically, tips 134 and 234 of multi-tool 10 engage teeth receiving openings 68 formed by spaced link plates 62 of roller chain 60 at opposite ends of chain link 50.

Figure 28B:
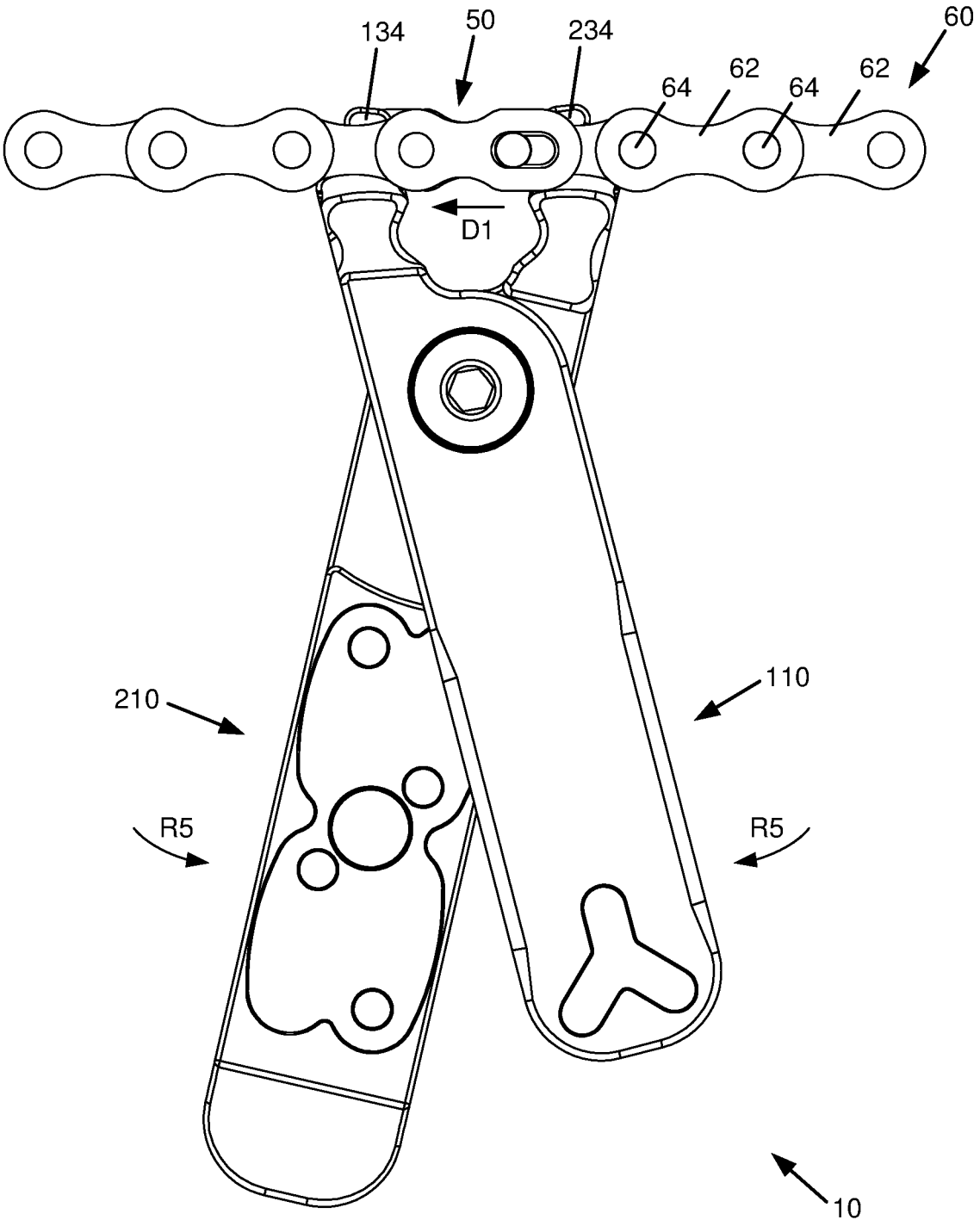
Figure 29B:
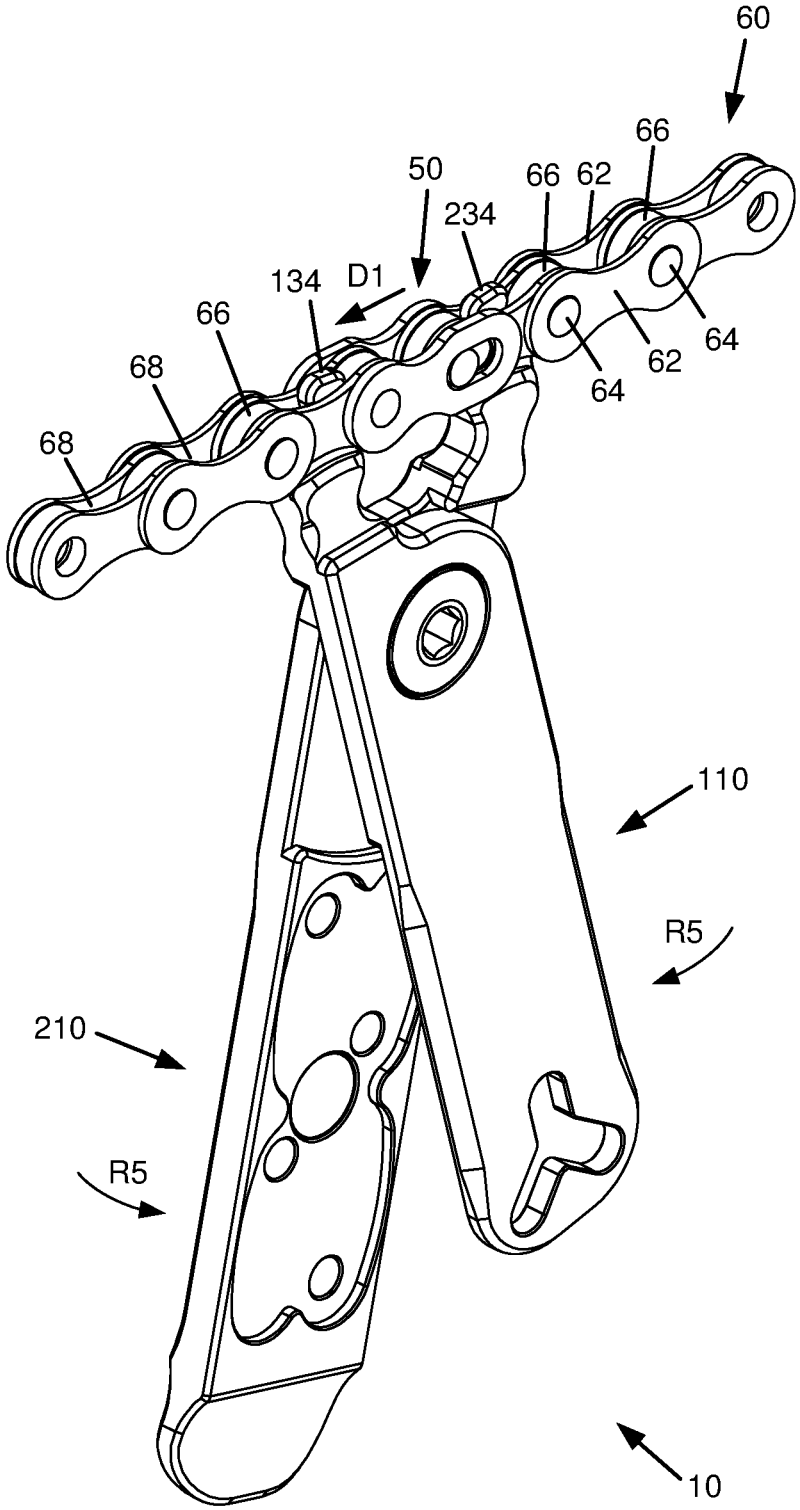

As such, as illustrated in the example of FIGS. 28B and 29B, handle portions 110 and 210 are pivoted toward each other (e.g., squeezed together), as represented by arrows R5, to disengage chain link 50, as represented by arrow D1. More specifically, engaging surfaces 137 and 237 (see, e.g., FIG. 27) of respective tips 134 and 234 engage chain link 50 and slide link pins of chain link 50 within link pin slots formed in respective link plates of chain link 50. As such, chain link 50 may be released and/or removed from roller chain 60.

Figure 28C:
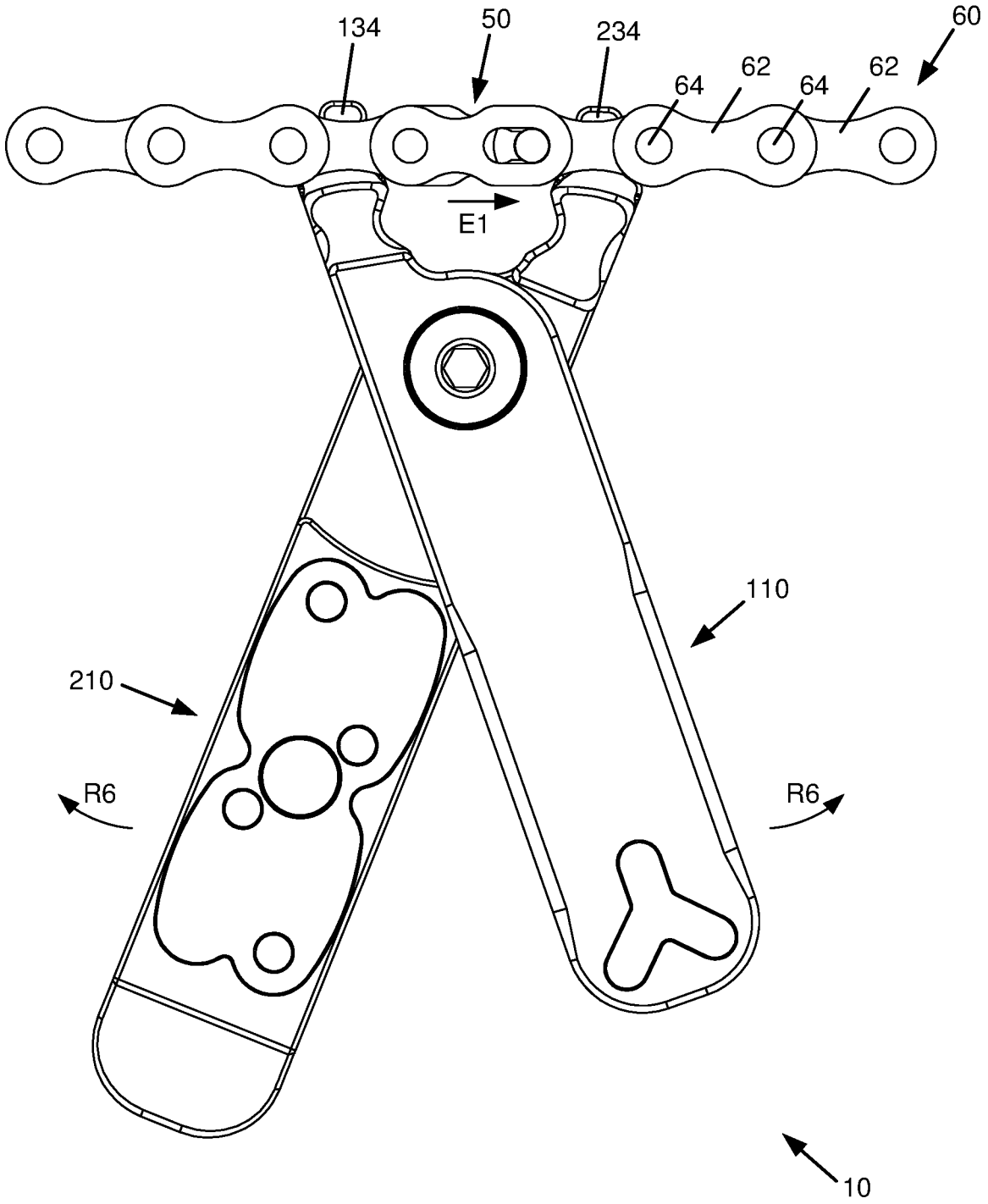
Figure 29C:
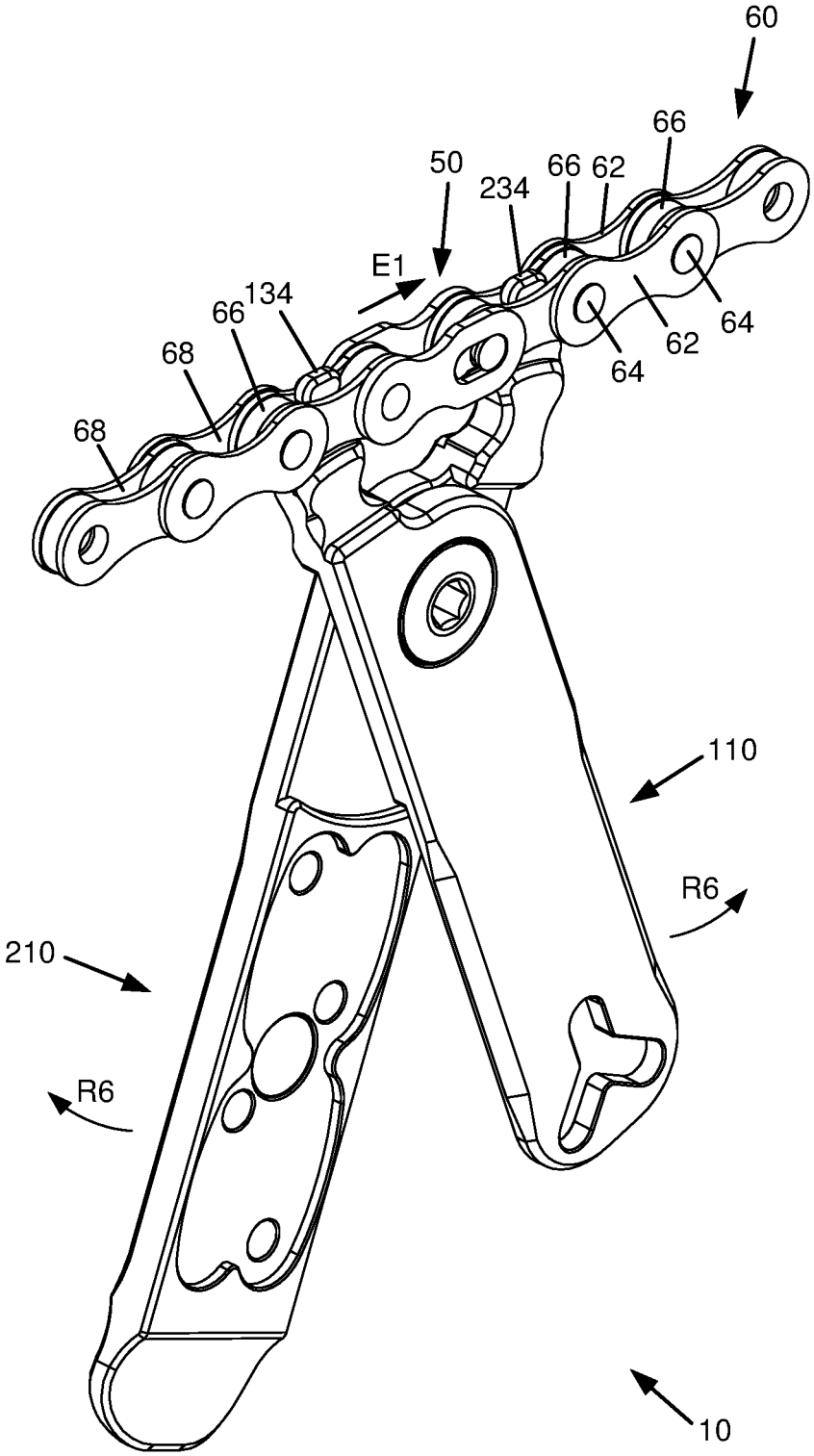

As illustrated in the example of FIGS. 28C and 29C, handle portions 110 and 210 are pivoted away from each other (e.g., pulled apart), as represented by arrows R6 to engage (or install) chain link 50, as represented by arrow E1. More specifically, engaging surfaces 136 and 236 (see, e.g., FIG. 27) of respective tips 134 and 234 engage cylindrical rollers 66 at opposite ends of chain link 50 and slide link pins of chain link 50 within link pin slots formed in respective link plates of chain link 50. As such, chain link 50 is installed on roller chain 60.

FIGS. 30A, 30B and FIGS. 31A, 31B are front and rear perspective views, respectively, illustrating an example of use of multi-tool 10. For example, multi-tool 10 may be used to store a chain link for a roller chain, such as a master link for a roller chain of a bicycle, including, for example, a Quick-Link by Shimano. More specifically, storage area 214 of handle portion 210 may be used to store a chain link for a roller chain, such as, for example, chain link 50.

In one example, chain link 50 includes a pair of corresponding link plates 51 and 52 having respective link pins 53 and 54 extending therefrom. As such, link pins 53 and 54 engage corresponding link pin slots 56 and 55 formed in respective link plates 52 and 51 to assemble chain link 50.

As illustrated in the example of FIGS. 30A, 30B and FIGS. 31A, 31B, recessed region 215 of storage area 214 is sized and shaped to receive link plates 51 and 52 of chain link 50, and holes 216 of storage area 214 are sized and positioned to receive link pins 53 and 54 extended from respective link plates 51 and 52.

Figure 30A:
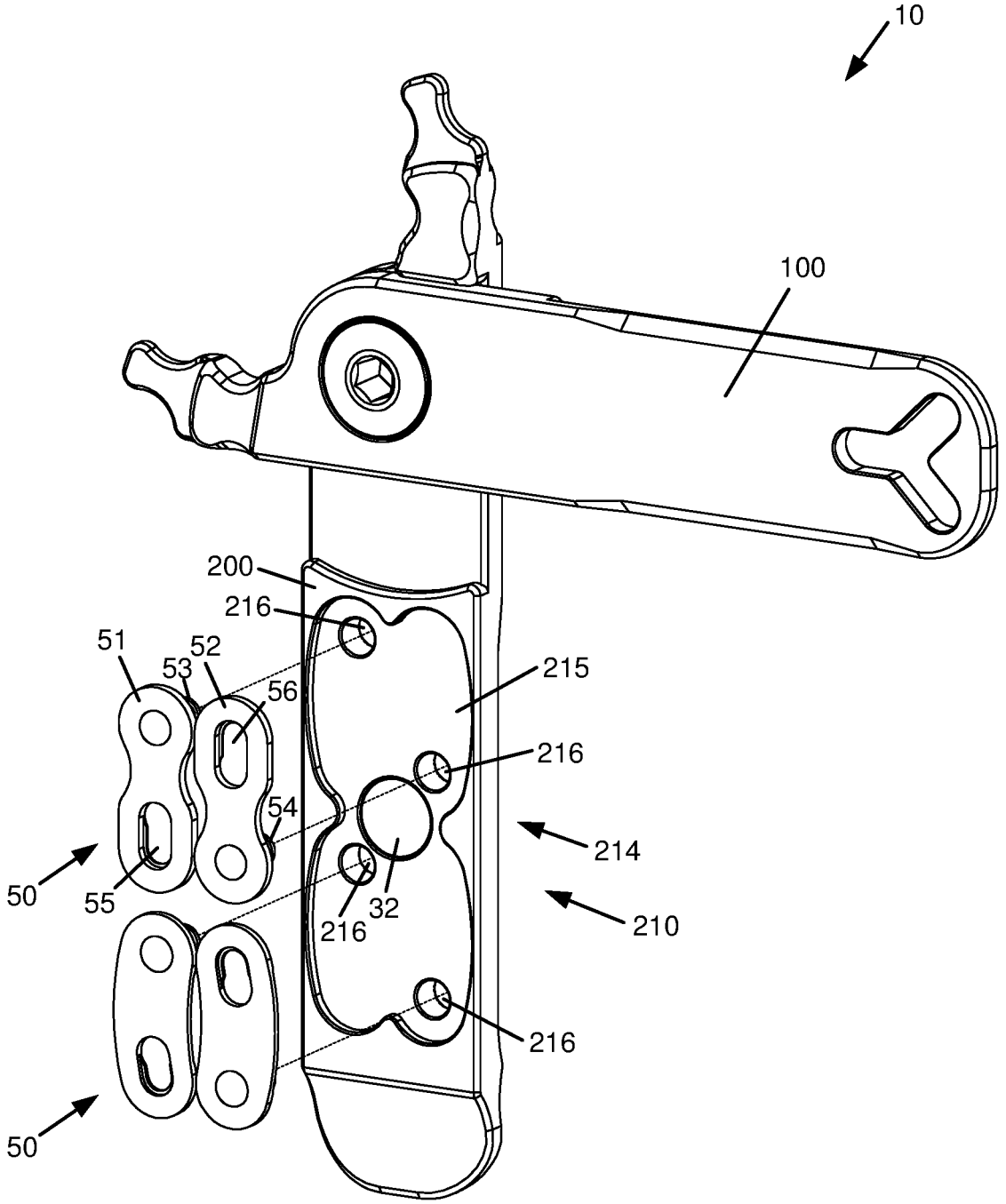
FIGS. 30A, 30B and FIGS. 31A, 31B are front and rear perspective views, respectively, illustrating an example of use of the multi-tool of FIGS. 1 and 2.
Figure 30B:
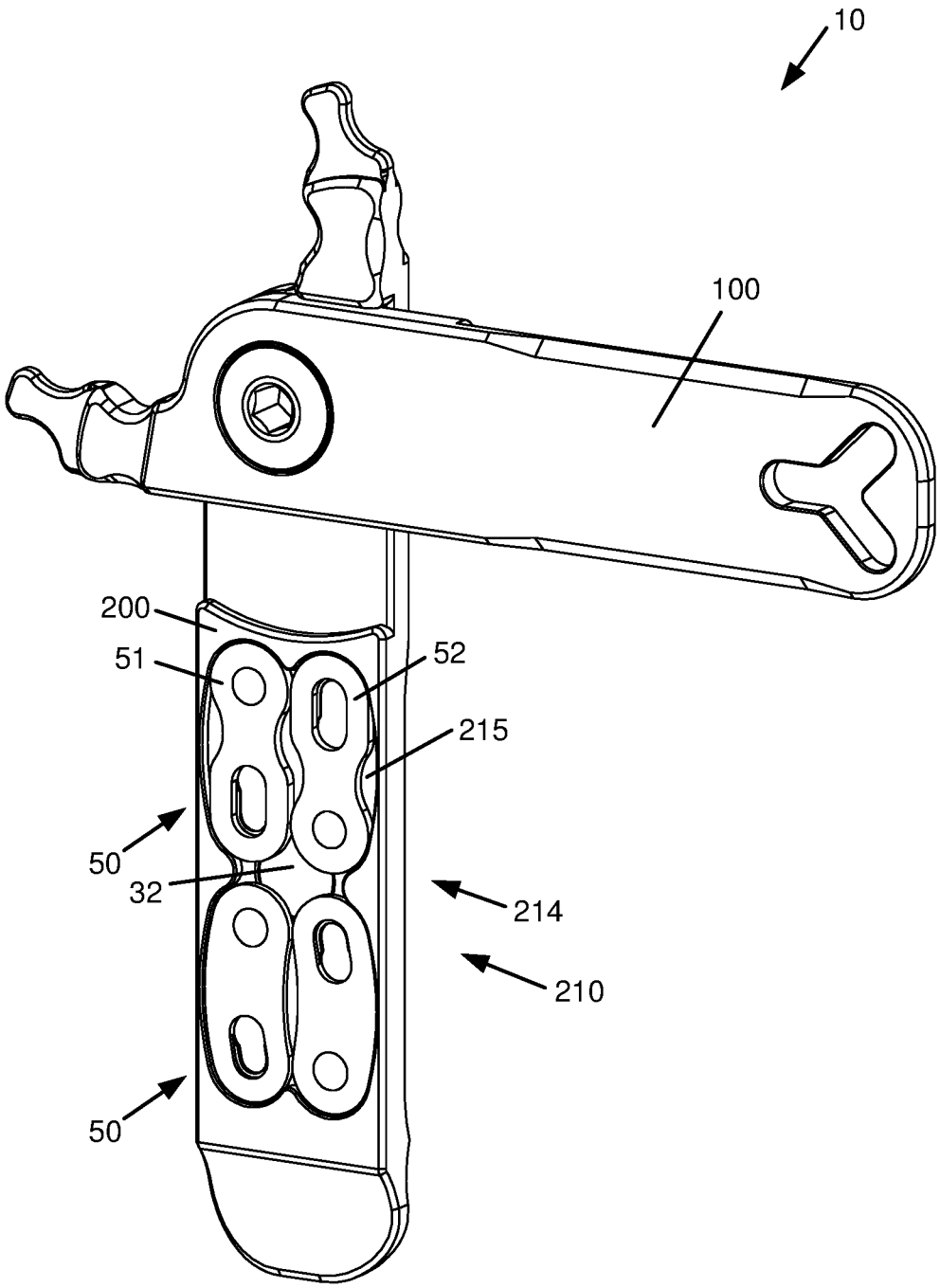
Figure 31A:
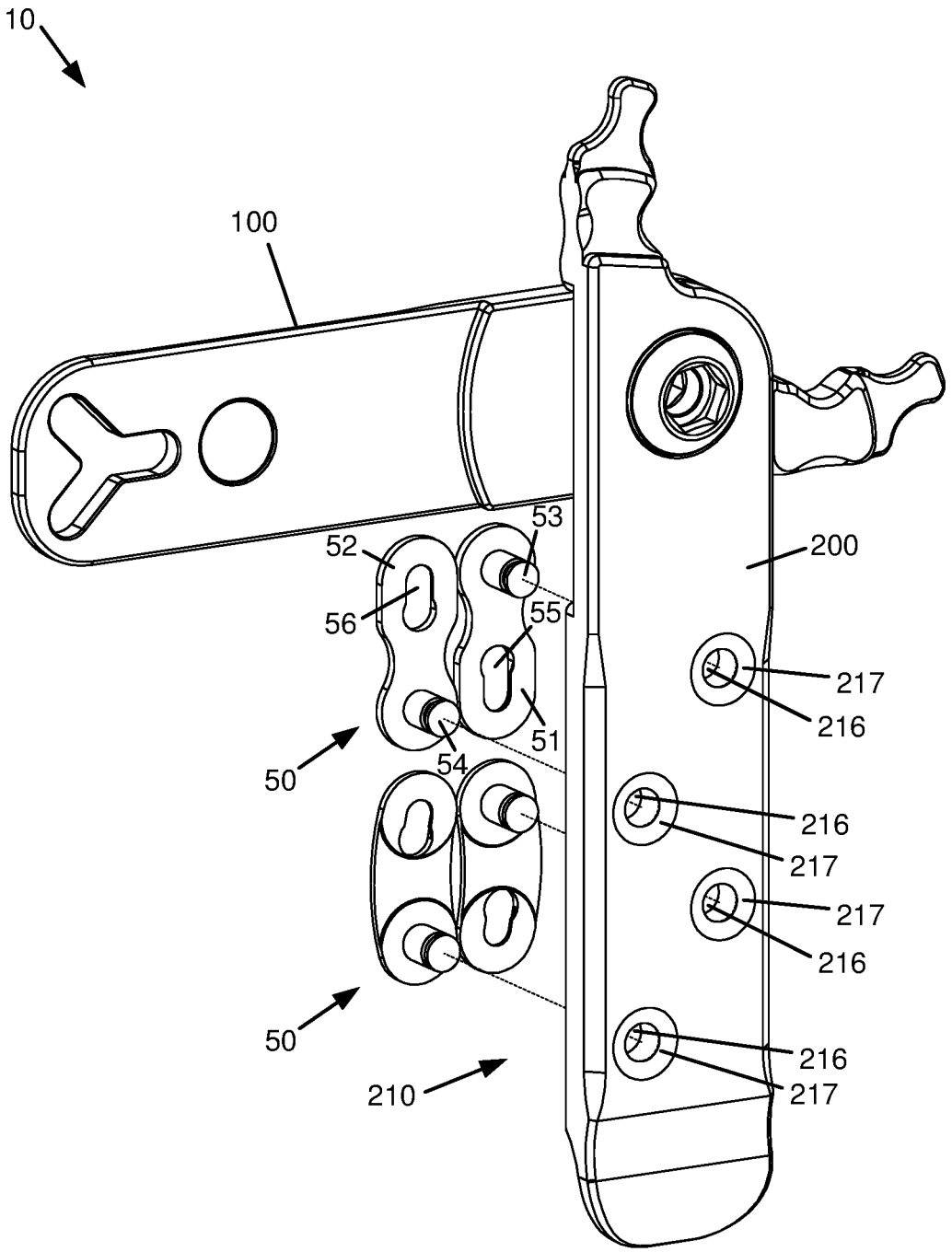
Figure 31B:
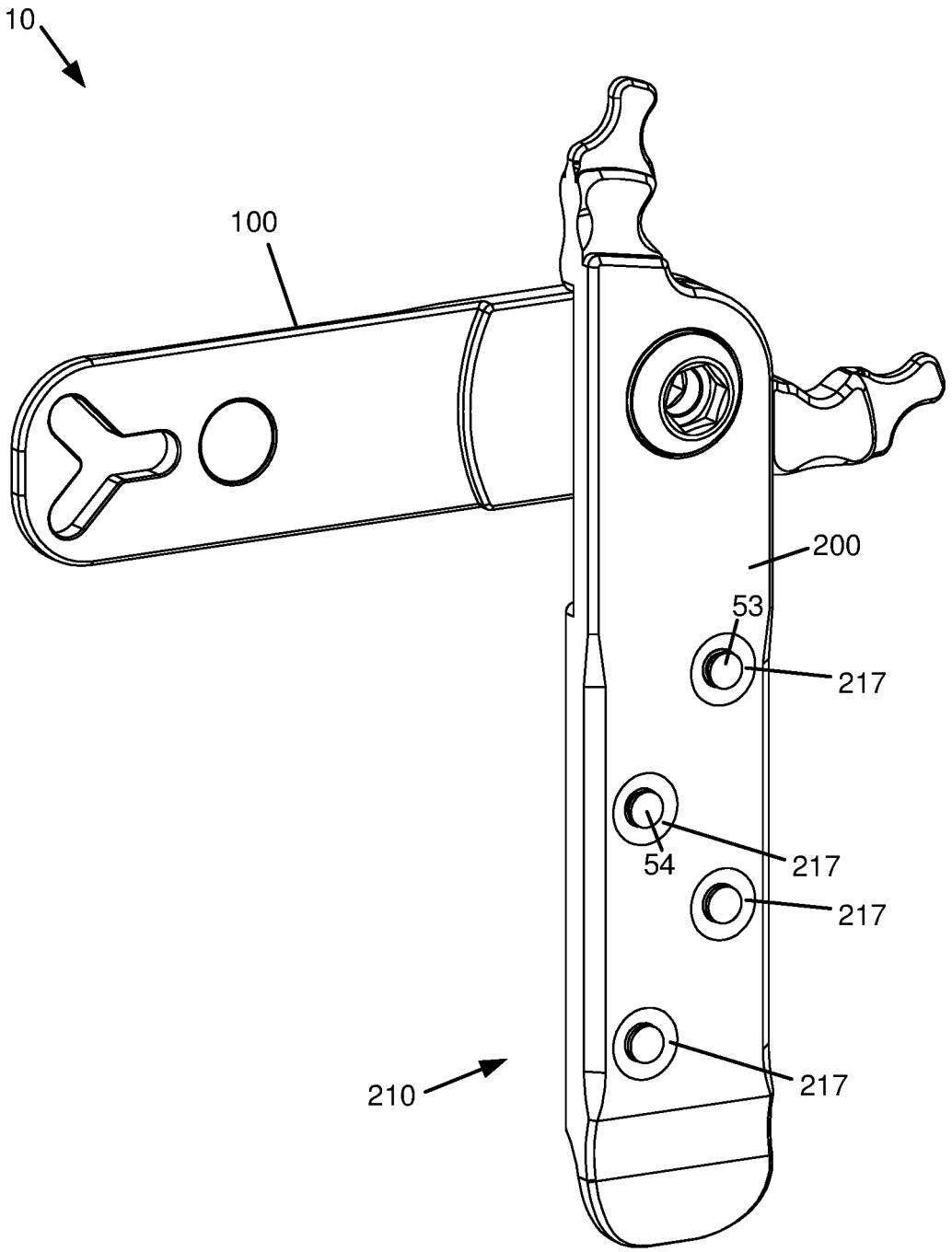

As illustrated in the example of FIGS. 30A and 31A, link pins 53 and 54 of respective link plates 51 and 52 engage and/or fit within respective holes 216 of storage area 214. In addition, link plates 51 and 52 fit within recessed region 215 of storage area 214. As such, as illustrated in the example of FIGS. 30B and 31B, link plates 51 and 52 of chain link 50 are stored within storage area 214 of multi-tool 10.

In one implementation, magnetic element 32 is positioned within recessed region 215 of storage area 214 such that link plates 51 and 52 each overlap at least a portion of magnetic element 32 when link plates 51 and 52 are positioned within recessed region 215. As such, link plates 51 and 52 are attracted by magnetic element 32 such that magnetic element 32 helps to retain or hold link plates 51 and 52 within recessed region 215 of storage area 214. In addition, in the closed position, plate 100 covers storage area 214 such that plate 100 helps to retain or hold link plates 51 and 52 within recessed region 215 of storage area 214.

In one example, holes 216 of storage area 214 include corresponding recesses 217 at side 202 of plate 200 such that respective ends of link pins 53 and 54 protrude into or through respective recesses 217. As such, recesses 217 help provide access to link pins 53 and 54 for removal of link plates 51 and 52 from storage area 214, for example, by pressing link pins 53 and 54 from side 202 of plate 200. In one example, recesses 217 include a countersink, counterbore, spot face or other recess. In one implementation, recesses 217 include a spherical countersink. In other examples, recesses 217 may include a beveled or chamfered countersink.

In the illustrated example, two chain links 50 (each including a pair of corresponding link plates 51 and 52 having respective link pins 53 and 54 and respective link pin slots 55 and 56) are stored within storage area 214. The number of chain links stored within storage area 214, however, may vary.

Figure 32:
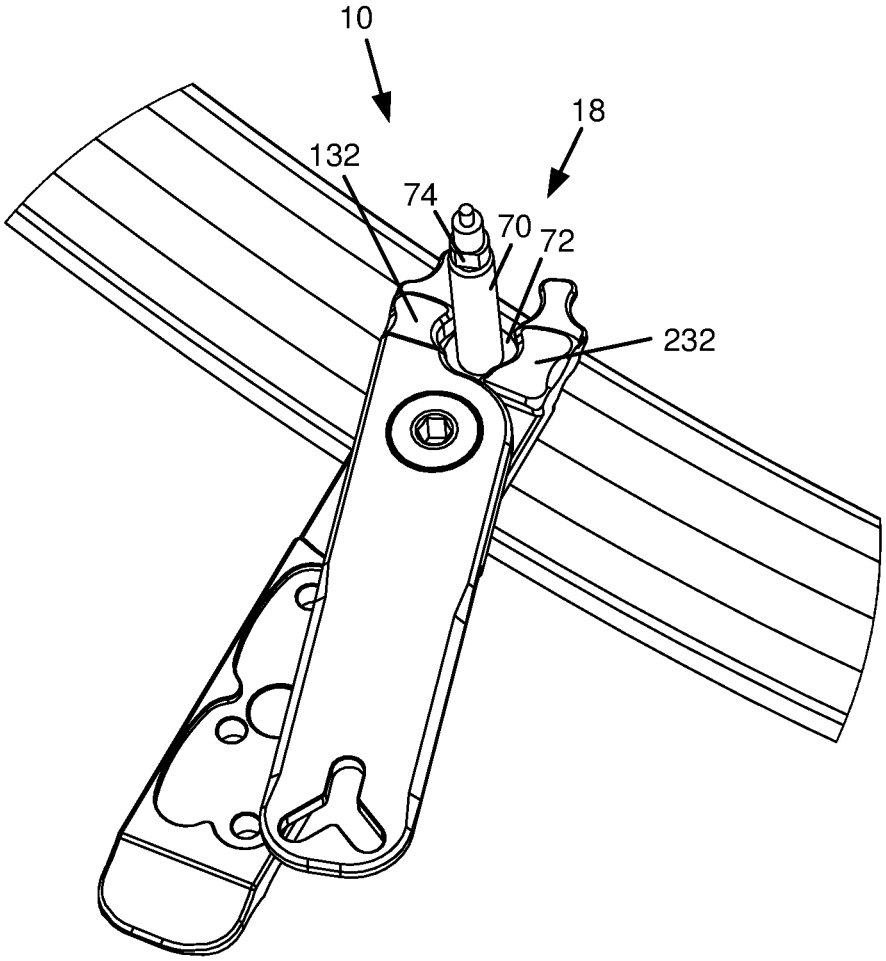
FIG. 32 illustrates an example of use of the multi-tool of FIGS. 1 and 2.

FIG. 32 illustrates an example of use of multi-tool 10. For example, multi-tool 10 may be used to grip and/or hold an object. More specifically, gripping jaws 18 of multi-tool 10 may be used to grip and/or hold an object. In one example, as illustrated in FIG. 32, gripping jaws 18, as formed by jaw sections 132 and 232, may be used to grip and/or hold a nut, such as a jam or retaining nut 72 (see also FIG. 33) of a valve stem 70 of an inner tube or a wheel rim, including, for example, an inner tube or a wheel rim of a bicycle. As such, with gripping jaws 18, jam or retaining nut 72 may be loosened and/or tightened or removed and/or installed.

Figure 33:
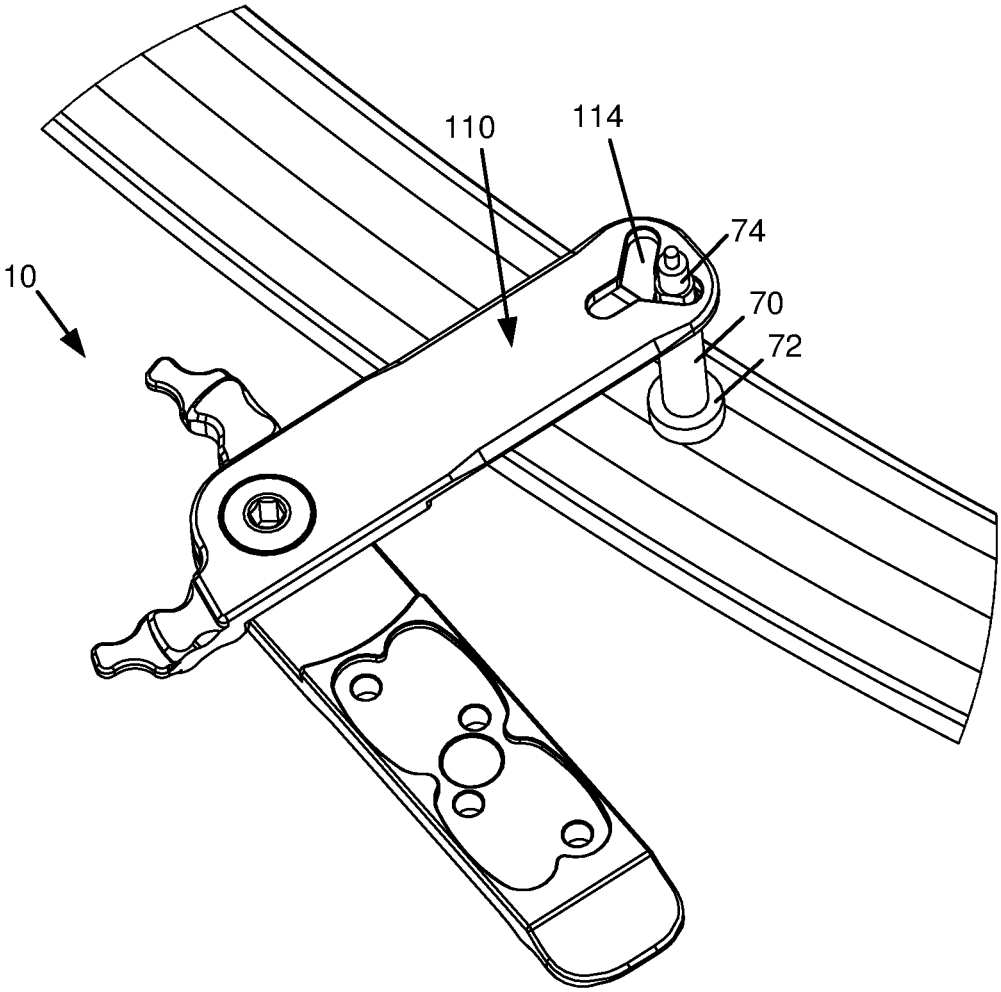
FIG. 33 illustrates an example of use of the multi-tool of FIGS. 1 and 2.

FIG. 33 illustrates an example of use of multi-tool 10. For example, multi-tool 10 may be used as a wrench. More specifically, opening 114 in handle portion 110 of plate 100 may be used as a wrench. In one example, as illustrated in FIG. 33, opening 114 in handle portion 110 may be used as a valve core removal tool. As such, opening 114 is configured to engage a valve core of a valve stem, such as a valve core 74 (see also FIG. 32) of a valve stem 70 of an inner tube or a wheel rim, including, for example, an inner tube or a wheel rim of a bicycle. Thus, with opening 114 in handle portion 110, valve core 74 may be loosened and/or tightened or removed and/or installed.

Figure 34:
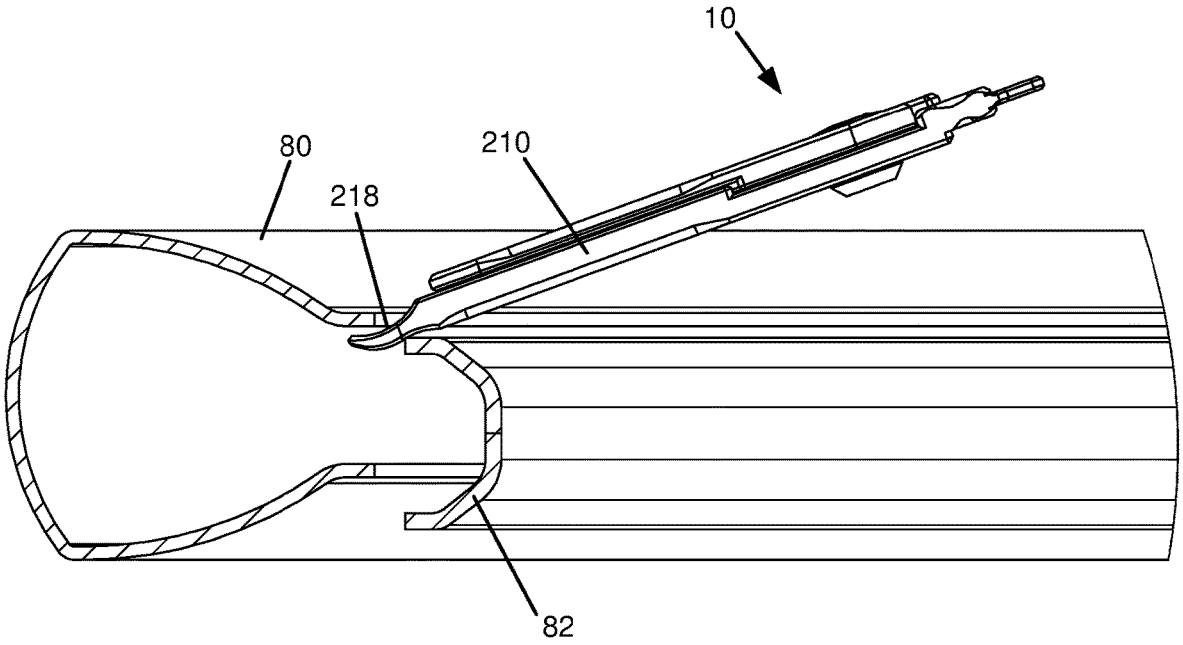
FIG. 34 illustrates an example of use of the multi-tool of FIGS. 1 and 2.

FIG. 34 illustrates an example of use of multi-tool 10. For example, multi-tool 10 may be used as a tire lever. More specifically, dished section 218 of handle portion 210 may be used as a tire lever spoon. In one example, as illustrated in the example of FIG. 34, dished section 218 of handle portion 210 may be used to remove a tire from and/or install a tire on a wheel rim, such as remove a tire 80 from and/or install a tire 80 on a wheel rim 82 of a bicycle.

A multi-tool as disclosed herein includes multiple features and provides multiple uses, including, for example, installing and/or removing a chain link of a roller chain, gripping jaws, chain link storage, magnetic closure, tire lever, and valve core removal.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A multi-tool, comprising:

a pair of plates having respective handle portions, joint portions, and head portions, the plates pivotally connected to each other at the joint portions and having respective opposite sides extended along the handle portions and respective opposite edges extended along the handle portions, one of the opposite edges of each of the plates including a contiguous planar surface extended along a portion of each of the handle portion, the joint portion, and the head portion of each of the plates, at least one of the plates to be pivoted relative to the other of the plates to establish an open position and a closed position of the plates, in the closed position of the plates, the plates to overlap each other with the handle portion of the at least one of the plates to cover the handle portion of the other of the plates, opposing sides of the opposite sides extended along the handle portions of the plates to face each other, and the opposite edges extended along the handle portions of the plates to be aligned with each other, the head portions of the plates including respective tips to disengage and engage a chain link of a roller chain, the tips to be aligned with each other in a common plane parallel with the plates.

2. The multi-tool of claim 1, the opposite edges of the plates further extended along the joint portions of the plates, and in the closed position of the plates, the opposite edges extended along the joint portions of the plates to be aligned.

3. The multi-tool of claim 1, the head portions of the plates having respective shoulders to limit rotation of the plates relative to each other.

4. The multi-tool of claim 1, the head portions of the plates including opposing, concave gripping surfaces aligned with each other in the common plane parallel with the plates, the opposing, concave gripping surfaces to form gripping jaws.

5. The multi-tool of claim 1, the handle portions of the plates including respective magnetic elements to magnetically couple the handle portions of the plates.

6. The multi-tool of claim 1, the handle portion of one of the plates including a storage area to receive and store a chain link for a roller chain, in the closed position of the plates, the other of the plates to cover the storage area.

7. The multi-tool of claim 6, the storage area including a recessed region formed in a side of the one of the plates and at least one hole formed through the one of the plates within the recessed region, the recessed region to receive a link plate of the chain link, and the at least one hole to receive a link pin extended from the link plate.

8. The multi-tool of claim 7, the at least one hole of the storage area including a corresponding recess at an opposite side of the one of the plates.

9. The multi-tool of claim 7, the recessed region of the storage area including a magnetic element to retain the link plate of the chain link within the recessed region.

10. A multi-tool, comprising:

a pair of plates pivotally connected to each other, each of the plates having a handle portion, a joint portion, and a head portion, and having an edge including a contiguous planar surface extended along a portion of each of the handle portion, the joint portion, and the head portion thereof, a thickness of the joint portion of one of the plates being less than a thickness of the handle portion of the one of the plates, and a thickness of the handle portion of the other of the plates being less than a thickness of the joint portion of the other of the plates, and in a closed position of the plates, the handle portion of the one of the plates to cover the handle portion of the other of the plates, with one side of the handle portion of the one of the plates facing an opposite side of the handle portion of the other of the plates and opposite edges of the handle portion of the one of the plates aligned with opposite edges of the handle portion of the other of the plates, the head portion of each of the plates including a jaw section to form gripping jaws, the gripping jaws including opposing, concave gripping surfaces.

11. The multi-tool of claim 10, the thickness of the joint portion of the one of the plates being less than the thickness of the handle portion of the one of the plates forming a shoulder on one side of the one of the plates, and the thickness of the handle portion of the other of the plates being less than the thickness of the joint portion of the other of the plates forming a shoulder on one side of the other of the plates.

12. The multi-tool of claim 11, the shoulder on the one side of the one of the plates and the shoulder on the one side of the other of the plates being correspondingly positioned on opposing sides of the plates such that the joint portion of the one of the plates and the joint portion of the other of the plates nest with each other.

13. The multi-tool of claim 10, the head portion of each of the plates including a tip to be received in a teeth receiving opening of a roller chain.

14. The multi-tool of claim 10, the handle portion of the one of the plates including a dished section to form a tire lever.

15. The multi-tool of claim 14, the handle portion of the other of the plates having an opening therethrough to form a wrench.

* * * * *